US007545368B2

(12) United States Patent
Tomohara

(10) Patent No.: US 7,545,368 B2
(45) Date of Patent: Jun. 9, 2009

(54) DISPLAY CONTROLLER, DISPLAY SYSTEM, AND DISPLAY CONTROL METHOD

(75) Inventor: Kiyohide Tomohara, Hino (JP)

(73) Assignee: Seiko Epson Corporation (JP)

( * ) Notice: Subject to any disclaimer, the term of this patent is extended or adjusted under 35 U.S.C. 154(b) by 578 days.

(21) Appl. No.: 11/049,635

(22) Filed: Feb. 2, 2005

(65) Prior Publication Data

US 2005/0177654 A1 Aug. 11, 2005

(30) Foreign Application Priority Data

Feb. 3, 2004 (JP) ..... 2004-026871

(51) Int. Cl.
*G09G 5/00* (2006.01)

(52) U.S. Cl. ..... 345/204

(58) Field of Classification Search ..... 345/204, 345/211

See application file for complete search history.

(56) References Cited

U.S. PATENT DOCUMENTS

| | | | | |
|---|---|---|---|---|
| 4,414,664 | A * | 11/1983 | Greenwood | 714/754 |
| 5,530,597 | A * | 6/1996 | Bowles et al. | 710/262 |
| 2001/0035862 | A1* | 11/2001 | Nakamura et al. | 345/204 |
| 2002/0107837 | A1* | 8/2002 | Osborne et al. | 707/2 |

FOREIGN PATENT DOCUMENTS

| | | |
|---|---|---|
| JP | 57-101892 | 6/1982 |
| JP | 60-37594 | 2/1985 |
| JP | 61-109490 | 7/1986 |
| JP | 63-240589 | 10/1988 |
| JP | 01-188181 | 7/1989 |
| JP | 1-136995 | 9/1989 |
| JP | 4-060692 | 2/1992 |
| JP | 4-60692 | 2/1992 |
| JP | 05-150743 | 6/1993 |
| JP | 10-282938 | 10/1998 |
| JP | 11-073159 | 3/1999 |

(Continued)

OTHER PUBLICATIONS

Communication from Japanese Patent Office re: related application.

(Continued)

*Primary Examiner*—Richard Hjerpe
*Assistant Examiner*—Shaheda A Abdin
(74) *Attorney, Agent, or Firm*—Harness, Dickey & Peirce, P.L.C.

(57) ABSTRACT

A display controller includes a frame memory, an interrupt output cycle setting register, and an interrupt signal generation section. The frame memory stores the display data for at least one vertical scan period, the display data being supplied from a host. An output cycle of an interrupt signal to be output to the host is set in units of one vertical scan period in the interrupt output cycle setting register. The interrupt signal generation section outputs an interrupt signal having pulses in the output cycle set in the interrupt output cycle setting register to the host as the interrupt signal. The display controller stores the display data supplied from the host corresponding to the interrupt signal in the frame memory, reads the display data from the frame memory in a predetermined read cycle, and supplies the display data to the data driver.

10 Claims, 24 Drawing Sheets

FOREIGN PATENT DOCUMENTS

| | | |
|---|---|---|
| JP | 11-085368 | 3/1999 |
| JP | 11-85368 | 3/1999 |
| JP | 2002-055667 | 2/2002 |
| JP | 2003-131632 | 5/2003 |
| JP | 2003-302945 | 10/2003 |

OTHER PUBLICATIONS

Communication from Japanese Patent Office regarding corresponding application.

* cited by examiner

FIG. 19A

| RST | CLK | VSYNCINT | CNT1<5:0> | COUNTER OPERATION |
|---|---|---|---|---|
| 0 | — | — | — | RESET (0h) |
| 1 | ↑ | 1 | 0h | LOAD (=INTDIV<5:0>) |
| 1 | ↑ | 1 | other | DECREMENT (CNT1<5:0>-1) |
| 1 | ↑ | 0 | — | hold |
| 1 | other | — | — | hold |

FIG. 19B

| VSYNCINT | CNT1<5:0> | VSYNCDT |
|---|---|---|
| 0 | — | 0 |
| 1 | 0h | 1 |
| 1 | other | 0 |

DISPLAY CONTROLLER, DISPLAY SYSTEM, AND DISPLAY CONTROL METHOD

Japanese Patent Application No. 2004-26871, filed on Feb. 3, 2004, is hereby incorporated by reference in its entirety.

BACKGROUND OF THE INVENTION

The present invention relates to a display controller, a display system, and a display control method.

In recent years, a display device using an electroluminescent (EL) element has attracted attention. In particular, since an organic EL panel including an EL element formed using a thin film of an organic material is a self-emission type, a backlight becomes unnecessary, whereby a wide viewing angle is realized. Moreover, since the organic EL panel has a high response speed in comparison with a liquid crystal panel, a color video display can be easily realized using a simple configuration.

The organic EL panel is divided into a simple matrix type and an active matrix type in the same manner as the liquid crystal panel. When driving a simple matrix type organic EL panel, grayscale control may be performed using pulse width modulation (hereinafter abbreviated as "PWM"). A display controller outputs display data supplied from a host to a driver which drives the organic EL panel at a predetermined read timing, and performs grayscale control by outputting display control signals.

As described above, the EL element which makes up the organic EL panel has a high response speed in comparison with a liquid crystal element which makes up the liquid crystal panel. Therefore, while the refresh rate of the liquid crystal panel is 60 Hz, the refresh rate of the organic EL panel is 160 Hz, for example. Therefore, it is necessary for a data driver which drives the organic EL panel to read the display data 160 times per second and to drive data lines of the organic EL panel based on the display data, for example.

However, when displaying a video image, it suffices that the display image be changed at a rate of 15 Hz or 20 Hz which is suitable for the human eye. In this case, the data driver can display a video image at 16 Hz by repeatedly using the same display data 10 times, for example.

The display controller which supplies the display data or the like to the data driver includes a frame memory which stores the display data for one vertical scan period for example, and the display data from the host is stored in the frame memory. Since the host cannot rewrite the display data for one frame (one vertical scan period) at a rate of 160 Hz, the host counts the number of frames and supplies the display data to the display controller in a predetermined frame cycle. Therefore, an additional processing load is imposed on the host.

BRIEF SUMMARY OF THE INVENTION

A first aspect of the present invention relates to a display controller which supplies display data to a data driver which drives a display panel including a plurality of scan lines and a plurality of data lines based on the display data, the display controller including:

a frame memory which stores the display data for at least one vertical scan period, the display data being supplied from a host;

an interrupt output cycle setting register in which an output cycle of an interrupt signal to be output to the host is set in units of one vertical scan period; and an interrupt signal generation section which outputs a first interrupt signal having pulses in the output cycle set in the interrupt output cycle setting register to the host as the interrupt signal;

wherein the display controller stores the display data supplied from the host corresponding to the interrupt signal in the frame memory, reads the display data from the frame memory in a predetermined read cycle, and supplies the display data to the data driver.

A second aspect of the present invention relates to a display system, including:

a display panel which includes:

a plurality of scan lines;

a plurality of data lines; and a plurality of electroluminescent elements, each of the electroluminescent elements being specified by one of the plurality of scan lines and one of the plurality of data lines;

a scan driver which scans the plurality of scan lines;

a data driver which drives the plurality of data lines; and the above display controller;

wherein the display controller outputs the interrupt signal to the host, stores the display data supplied from the host corresponding to the interrupt signal in the frame memory, reads the display data from the frame memory in a predetermined read cycle, and outputs the display data to the data driver.

A third aspect of the present invention relates to a display control method for supplying display data to a data driver which drives a display panel including a plurality of scan lines and a plurality of data lines based on the display data, the display control method including:

outputting an interrupt signal to a host in an output cycle in units of one vertical scan period;

receiving the display data supplied from the host corresponding to the interrupt signal, and storing the display data for at least one vertical scan period in a frame memory; and reading the display data from the frame memory in a predetermined read cycle, and supplying the display data to the data driver.

BRIEF DESCRIPTION OF THE SEVERAL VIEWS OF THE DRAWING

FIG. 19A is a table for illustrating an operation of the cycle counter shown in FIG. 18, and FIG. 19B is a table for illustrating an operation of the vertical synchronization detection section shown in FIG. 18.

DETAILED DESCRIPTION OF THE EMBODIMENTS

Figure 1:
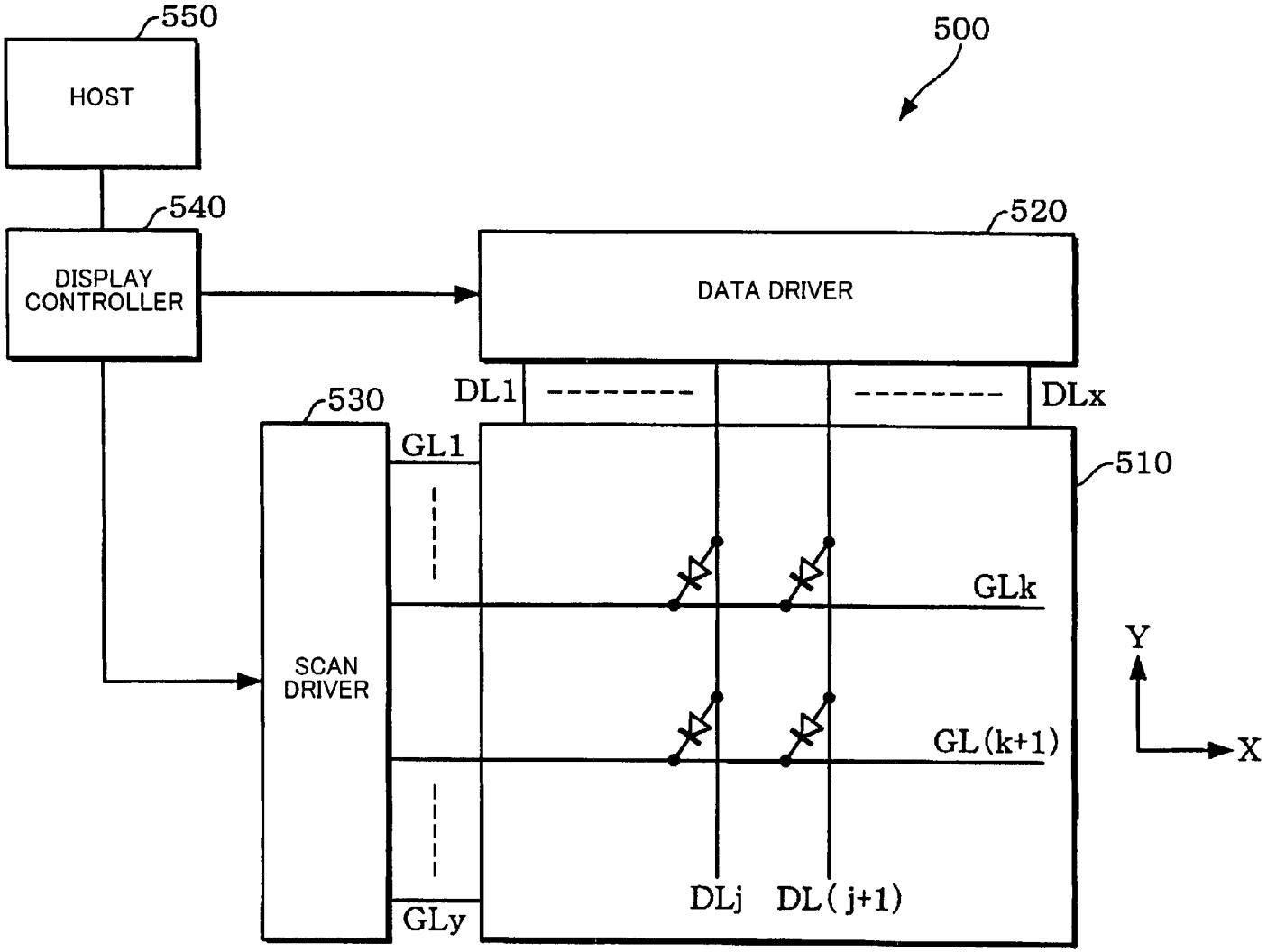
FIG. 1 is a block diagram showing a display system according to one embodiment of the present invention.

The embodiments of the present invention has been achieved in view of the above-described technical problem, and may provide a display controller, a display system, and a display control method which reduce processing load imposed on a host which supplies display data for driving a high-refresh-rate display panel to a display controller.

An embodiment of the present invention provides a display controller which supplies display data to a data driver which drives a display panel including a plurality of scan lines and a plurality of data lines based on the display data, the display controller including:

a frame memory which stores the display data for at least one vertical scan period, the display data being supplied from a host;

an interrupt output cycle setting register in which an output cycle of an interrupt signal to be output to the host is set in units of one vertical scan period; and an interrupt signal generation section which outputs a first interrupt signal having pulses in the output cycle set in the interrupt output cycle setting register to the host as the interrupt signal;

wherein the display controller stores the display data supplied from the host corresponding to the interrupt signal in the frame memory, reads the display data from the frame memory in a predetermined read cycle, and supplies the display data to the data driver.

In this embodiment, the display controller which outputs the display data supplied from the host to the data driver includes the interrupt output cycle setting register in which the output cycle of the interrupt signal output to the host is set in units of one vertical scan period. The display controller outputs the interrupt signal having pulses in the output cycle set in the interrupt output cycle setting register to the host. The display controller stores the display data supplied from the host corresponding to the interrupt signal in the frame memory, reads the display data from the frame memory in a predetermined read cycle, and supplies the display data to the data driver. This makes it unnecessary for the host to count the number of frames display-controlled by the data driver or the like so as not to write the display data in vertical scan period units, whereby the processing load imposed on the host can be reduced. Moreover, since it suffices that the host merely output the display data in response to the interrupt signal asynchronously with a read control of the display data by the display controller, the control of the host can be simplified.

This display controller may include an interrupt output setting register for selecting whether to pulse-output or level-output the interrupt signal;

the interrupt signal generation section may generate a second interrupt signal which is set to active when the output cycle set in the interrupt output cycle setting register has elapsed from a preceding active change timing and is set to inactive by the host, and may output the first or second interrupt signal to the host as the interrupt signal based on a value set in the interrupt output setting register.

With this display controller, the interrupt signal generation section may generate the second interrupt signal which is set to active when the output cycle set in the interrupt output cycle setting register has elapsed from an inactive setting timing of the host.

Since either the pulse-output interrupt signal or the level-output interrupt signal which can be released by the host can be selected, the interrupt signal corresponding to the host can be output.

This display controller may include an interrupt output enable setting register in which enable setting of output of the interrupt signal is set; and the interrupt signal generation section may output the interrupt signal to the host when the interrupt signal is enabled in the interrupt output enable setting register, and may mask the output of the interrupt signal when the interrupt signal is disabled in the interrupt output enable setting register.

Since the interrupt signal is masked, execution of unnecessary interrupt processing can be omitted.

With this display controller, the read cycle may be a period longer than the one vertical scan period.

When the read cycle from the frame memory is a period longer than one vertical scan period, it is difficult to write the display data into the frame memory in vertical scan period units. In this case, it is necessary for the host to count the number of frames display-controlled by the data driver or the like. However, since this embodiment eliminates the need for the count processing, the processing load imposed on the host can be reduced. Therefore, the host can use the saved processing performance for another processing.

Another embodiment of the present invention provides a display system, including:

a display panel which includes:

a plurality of scan lines;

a plurality of data lines; and a plurality of electroluminescent elements, each of the electroluminescent elements being specified by one of the plurality of scan lines and one of the plurality of data lines;

a scan driver which scans the plurality of scan lines;

a data driver which drives the plurality of data lines; and any one of the above display controller;

wherein the display controller outputs the interrupt signal to the host, stores the display data supplied from the host corresponding to the interrupt signal in the frame memory, reads the display data from the frame memory in a predetermined read cycle, and outputs the display data to the data driver.

This makes it possible to provide a display system which can reduce the processing of the host with a simple configuration.

A further embodiment of the present invention provides a display control method for supplying display data to a data driver which drives a display panel including a plurality of scan lines and a plurality of data lines based on the display data, the display control method including:

outputting an interrupt signal to a host in an output cycle in units of one vertical scan period;

receiving the display data supplied from the host corresponding to the interrupt signal, and storing the display data for at least one vertical scan period in a frame memory; and reading the display data from the frame memory in a predetermined read cycle, and supplying the display data to the data driver.

With this display control method, the read cycle may be a period longer than the one vertical scan period.

These embodiments will be described below in detail with reference to the drawings. Note that the embodiments do not in any way limit the scope of the invention laid out in the claims herein. In addition, not all of the elements of the embodiments described below should be taken as essential requirements of the present invention.

1. Display System

FIG. 1 shows a display system.

A display system 500 includes an organic EL panel (display panel in a broad sense) 510, a data driver 520, a scan driver 530, and a display controller 540. The display system 500 does not necessarily include all of these circuit blocks. The display system 500 may have a configuration in which some of the circuit blocks are omitted. The display system 500 may be configured to include a host 550.

The organic EL panel 510 is a simple matrix type. FIG. 1 shows an electrical configuration of the organic EL panel 510. Specifically, the organic EL panel 510 includes a plurality of scan lines (cathodes in a narrow sense), a plurality of data lines (anodes in a narrow sense), and a plurality of organic EL elements (electroluminescent elements in a broad sense; display elements in a broader sense), each of the organic EL elements being connected with one of the scan lines and one of the data lines.

In more detail, the organic EL panel is formed on a glass substrate. A plurality of data lines DL1 to DLx (x is an integer of two or more), arranged in a direction X shown in FIG. 1 and extending in a direction Y, are formed on the glass substrate. A plurality of scan lines GL1 to GLy (y is an integer of two or more), arranged in the direction Y shown in FIG. 1 and extending in the direction X, are formed on the glass substrate so that the scan lines intersect the data lines. In the case where one pixel is made up of three color components consisting of an R component, a G component, and a B component, a plurality of sets of data lines, each of the sets consisting of an R component data line, a G component data line, and a B component data line, are arranged in the organic EL panel 510.

An organic EL element is formed at a position corresponding to the intersecting point of the data line DLj ($1 \leqq j \leqq x$, j is an integer) and the scan line GLk ($1 \leqq k \leqq y$, k is an integer). Therefore, each of the organic EL elements is specified by one of the scan lines and one of the data lines.

Figure 2:
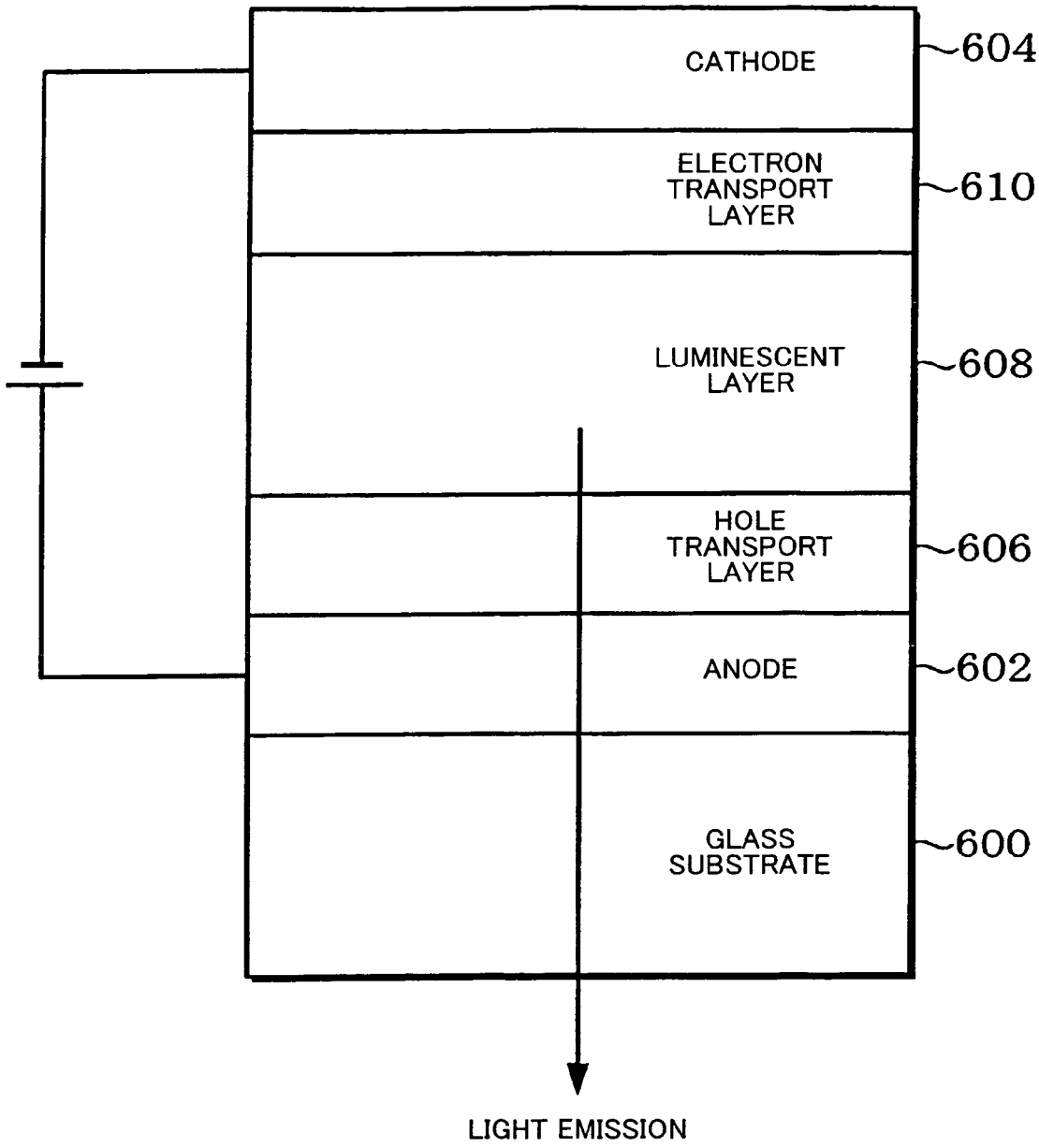
FIG. 2 is illustrative of an organic EL element.

FIG. 2 shows the organic EL element.

In the organic EL element, a transparent electrode (indium thin oxide (ITO), for example) which functions as an anode 602 provided as the data line is formed on a glass substrate 600. A cathode 604 provided as the scan line is formed above the anode 602. An organic layer including a luminescent layer and the like is formed between the anode 602 and the cathode 604.

The organic layer includes a hole transport layer 606 formed on the upper surface of the anode 602, a luminescent layer 608 formed on the upper surface of the hole transport layer 606, and an electron transport layer 610 formed between the luminescent layer 608 and the cathode 604.

A hole from the anode 602 and an electron from the cathode 604 are recombined in the luminescent layer 608 by applying a potential difference between the data line and the scan line, specifically, by applying a potential difference between the anode 602 and the cathode 604. The molecules of the luminescent layer 608 are excited by the energy generated, and the energy released when the molecules return to the ground state becomes light. The light passes through the anode 602 formed of a transparent electrode and the glass substrate 600.

In FIG. 1, the data driver 520 drives the data line based on grayscale data (display data in a broad sense). The data driver 520 generates a PWM signal having a pulse width corresponding to the grayscale data, and drives the data line based on the PWM signal.

The scan driver 530 sequentially selects the scan lines. As a result, current flows through the organic EL element connected with the data line which intersects the selected scan line, whereby emission of light occurs.

The display controller 540 controls the data driver 520 and the scan driver 530 according to the content set by the host 550 such as a central processing unit (CPU). In more detail, the display controller 540 sets an operation mode of the data driver 520, and supplies a latch pulse (horizontal synchronization signal) LP, a grayscale clock signal GCLK (R component grayscale signal GCLKR, G component grayscale clock signal GCLKG, and B component grayscale clock signal GCLKB) for generating the PWM signal, a dot clock signal DCLK, a discharge signal DIS1 (horizontal blanking adjustment signal in a broad sense), and grayscale data D generated therein to the data driver 520, for example. A horizontal scan period is specified by the latch pulse LP. The display controller 540 sets an operation mode of the scan driver 530, and supplies a vertical synchronization signal YD, the latch pulse LP, and a discharge signal DIS2 (vertical blanking adjustment signal in a broad sense) generated therein to the scan driver 530, for example. A vertical scan period is specified by the vertical synchronization signal YD.

Some or all of the data driver 520, the scan driver 530, and the display controller 540 may be formed on the organic EL panel 510.

1.1 Data Driver

Figure 3:
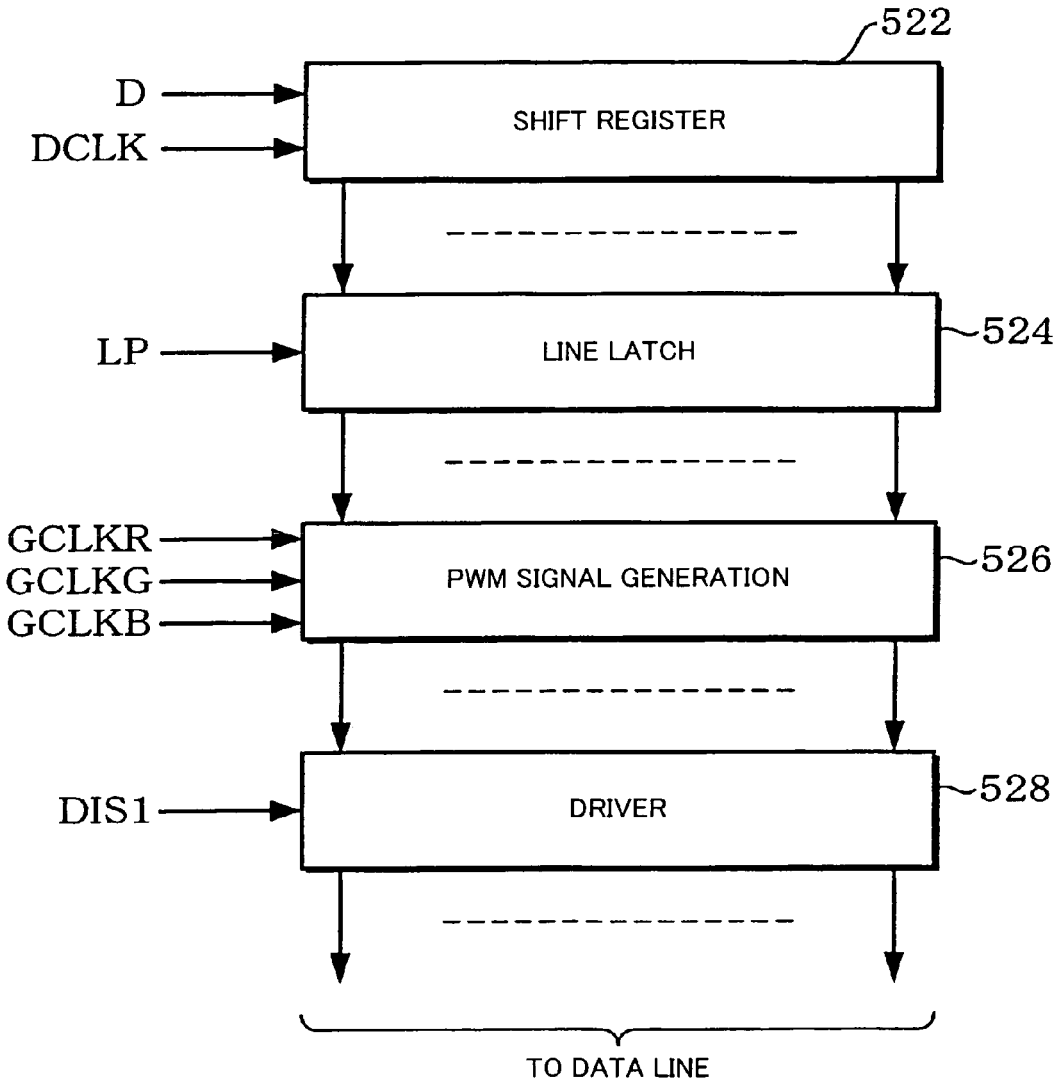
FIG. 3 shows the data driver of FIG. 1.

FIG. 3 shows the data driver 520 shown in FIG. 1.

The data driver 520 includes a shift register 522, a line latch 524, a PWM signal generation circuit 526, and a driver circuit 528.

The shift register 522 includes a plurality of flip-flops, each of the flip-flops being provided corresponding to one of the data lines and sequentially connected. The dot clock signal DCLK from the display controller 540 is input to each of the flip-flops. R component grayscale data, G component grayscale data, B component grayscale data, R component grayscale data, . . . are sequentially input to the flip-flop in the first stage of the shift register 522 from the display controller 540 in four bit units in synchronization with the dot clock signal DCLK, for example. The R component grayscale data is data for driving the R component data line. The G component grayscale data is data for driving the G component data line.

The B component grayscale data is data for driving the B component data line. The shift register 522 stores the grayscale data in synchronization with the dot clock signal DCLK while shifting the grayscale data.

The line latch 524 latches the grayscale data in one horizontal scan unit stored in the shift register 522 in synchronization with the latch pulse LP supplied from the display controller 540.

The PWM signal generation circuit 526 generates the PWM signal for driving the data line. In more detail, the PWM signal generation circuit 526 generates the PWM signal whose change point is specified by the grayscale clock signal (grayscale pulse of the grayscale clock signal in more detail) based on the grayscale data corresponding to the data line. The PWM signal has a pulse width in the number of clock cycles of the grayscale clock signal GCLK corresponding to the grayscale data. The PWM signal generation circuit 526 generates a PWM signal PWMR for the R component data line using the R component grayscale clock signal GCLKR and the R component grayscale data stored corresponding to the data line. The PWM signal generation circuit 526 generates a PWM signal PWMG for the G component data line using the G component grayscale clock signal GCLKG and the G component grayscale data stored corresponding to the data line. The PWM signal generation circuit 526 generates a PWM signal PWMB for the B component data line using the B component grayscale clock signal GCLKB and the B component grayscale data stored corresponding to the data line.

The driver circuit 528 drives the data line based on the PWM signal generated by the PWM signal generation circuit 526. The discharge signal DIS1 from the display controller 540 is input to the driver circuit 528. A horizontal display period within the horizontal scan period specified by the latch pulse LP is specified by the discharge signal DIS1. The horizontal display period is a period which starts at the falling edge of the discharge signal DIS1 and ends at the next rising edge of the discharge signal DIS1. A pulse of the latch pulse LP is output within a period in which the discharge signal DIS1 is set at the H level.

The driver circuit 528 connects the data line with a ground potential when the discharge signal DIS1 is set at the H level, and supplies a predetermined current to the data line for a period corresponding to the pulse width of the PWM signal when the discharge signal DIS1 is set at the L level.

The data driver 520 prevents the data line from being driven by the grayscale data in the middle of rewriting by latching the grayscale data in the next horizontal scan period in the line latch 524 when the discharge signal DIS1 is set at the H level.

1.2 Scan Driver

Figure 4:
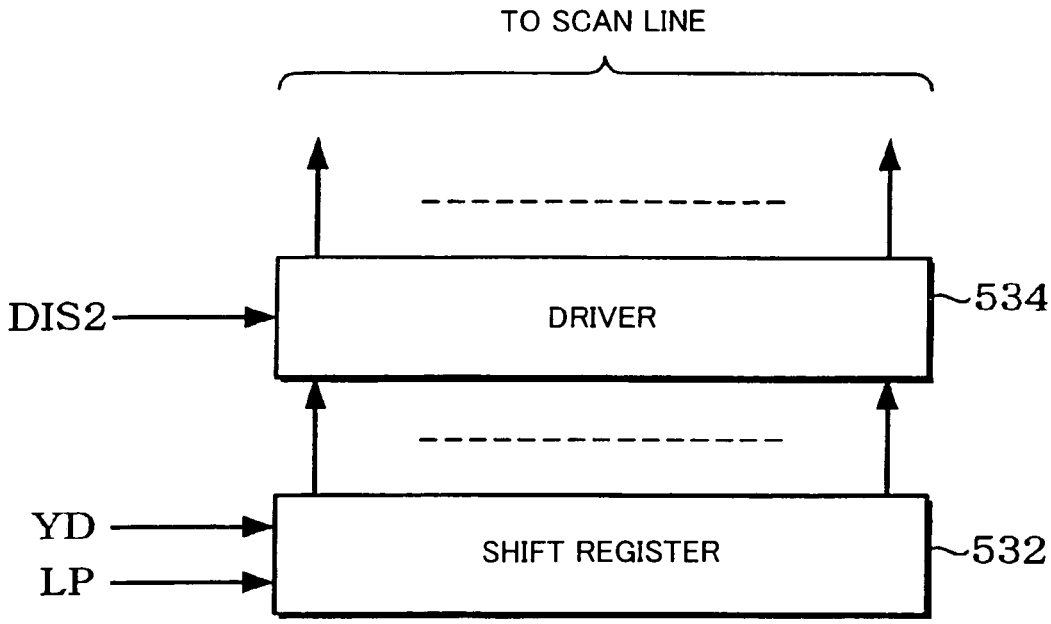
FIG. 4 shows the scan driver of FIG. 1.

FIG. 4 shows the scan driver 530 shown in FIG. 1.

The scan driver 530 includes a shift register 532 and a driver circuit 534.

The shift register 532 includes a plurality of flip-flops, each of the flip-flops being provided corresponding to one of the scan lines and sequentially connected. The latch pulse LP from the display controller 540 is input to each of the flip-flops. The vertical synchronization signal YD from the display controller 540 is input to the flip-flop in the first stage of the shift register 532. The shift register 532 shifts the pulse of the vertical synchronization signal YD in synchronization with the latch pulse LP.

The driver circuit 534 sequentially outputs a select pulse to the scan line based on the output from the flip-flop of the shift register 532. The discharge signal DIS2 from the display controller 540 is input to the driver circuit 534. The driver circuit 534 connects all the scan lines with the ground potential when the discharge signal DIS2 is set at the H level. The driver circuit 534 connects only the selected scan line with the ground potential and connects the remaining scan lines with a predetermined potential when the discharge signal DIS2 is set at the L level.

1.3 Discharge Operation

Figure 5:
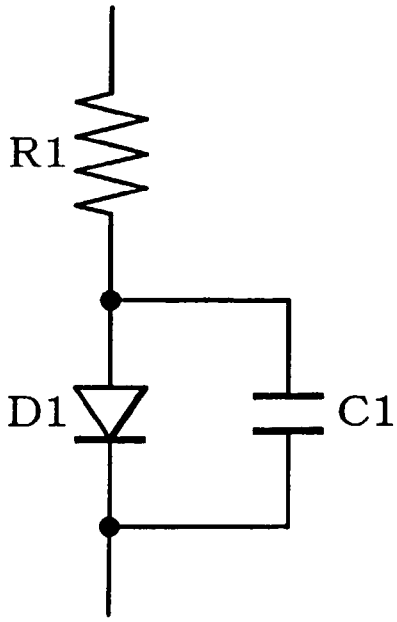
FIG. 5 shows an example of an electrical equivalent circuit diagram of the organic EL element.

FIG. 5 shows an example of an electrical equivalent circuit diagram of the organic EL element.

The organic EL element is considered to be equivalent to a configuration in which a resistance component R1 and a diode D1 are connected in series and a parasitic capacitor C1 is connected in parallel with the diode D1. The parasitic capacitor C1 is considered to be a capacitance component corresponding to a depletion layer formed at a junction when a potential difference is applied between the anode 602 and the cathode 604. Therefore, the organic EL element is considered to be a capacitive load.

Therefore, in the display system 500, the effect of the preceding horizontal scan period can be eliminated by performing a discharge operation of the organic EL elements of the organic EL panel 510 using the discharge signals DIS1 and DIS2.

Figure 6:
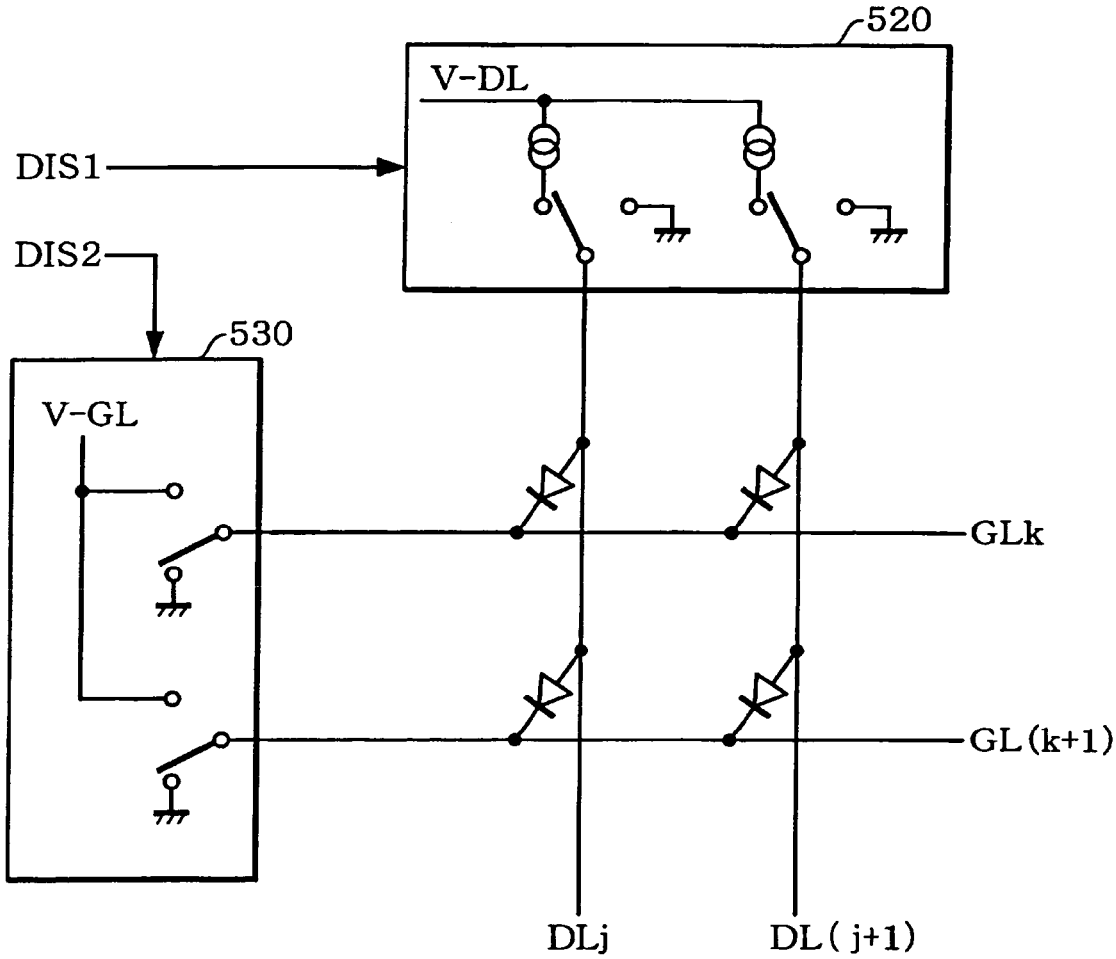
FIG. 6 is a diagram illustrative of the discharge operation.

FIG. 6 is a diagram illustrative of the discharge operation. In FIG. 6, components corresponding to those in the display system shown in FIG. 1 are denoted by the same reference numbers.

The data driver 520 supplies a predetermined current to the data line for a period corresponding to the pulse width of the PWM signal when the discharge signal DIS1 is set at the L level. The data driver 520 connects all the data lines with the ground potential when the discharge signal DIS1 is set at the H level.

When the discharge signal DIS2 is set at the L level, the scan driver 530 connects only the selected scan line with the ground potential and connects the remaining scan lines with a potential V-GL. The scan driver 530 connects all the scan lines with the ground potential when the discharge signal DIS2 is set at the H level.

Therefore, current flows through the organic EL element connected with the selected scan line when the discharge signals DIS1 and DIS2 are set at the L level. The potentials of opposite ends of the organic EL elements become equal when the discharge signals DIS1 and DIS2 are set at the H level, whereby the organic EL elements can be discharged.

A flicker which may occur depending on the type and manufacturing variation of the organic EL panel can be prevented or luminance can be adjusted by adjusting the length of the horizontal display period within the horizontal scan period. A blanking period can be adjusted by using the discharge signals DIS1 and DIS2. Therefore, the discharge signal DIS1 may be called a horizontal blanking adjustment signal, and the discharge signal DIS2 may be called a vertical blanking adjustment signal.

2. Display Controller

Figure 7:
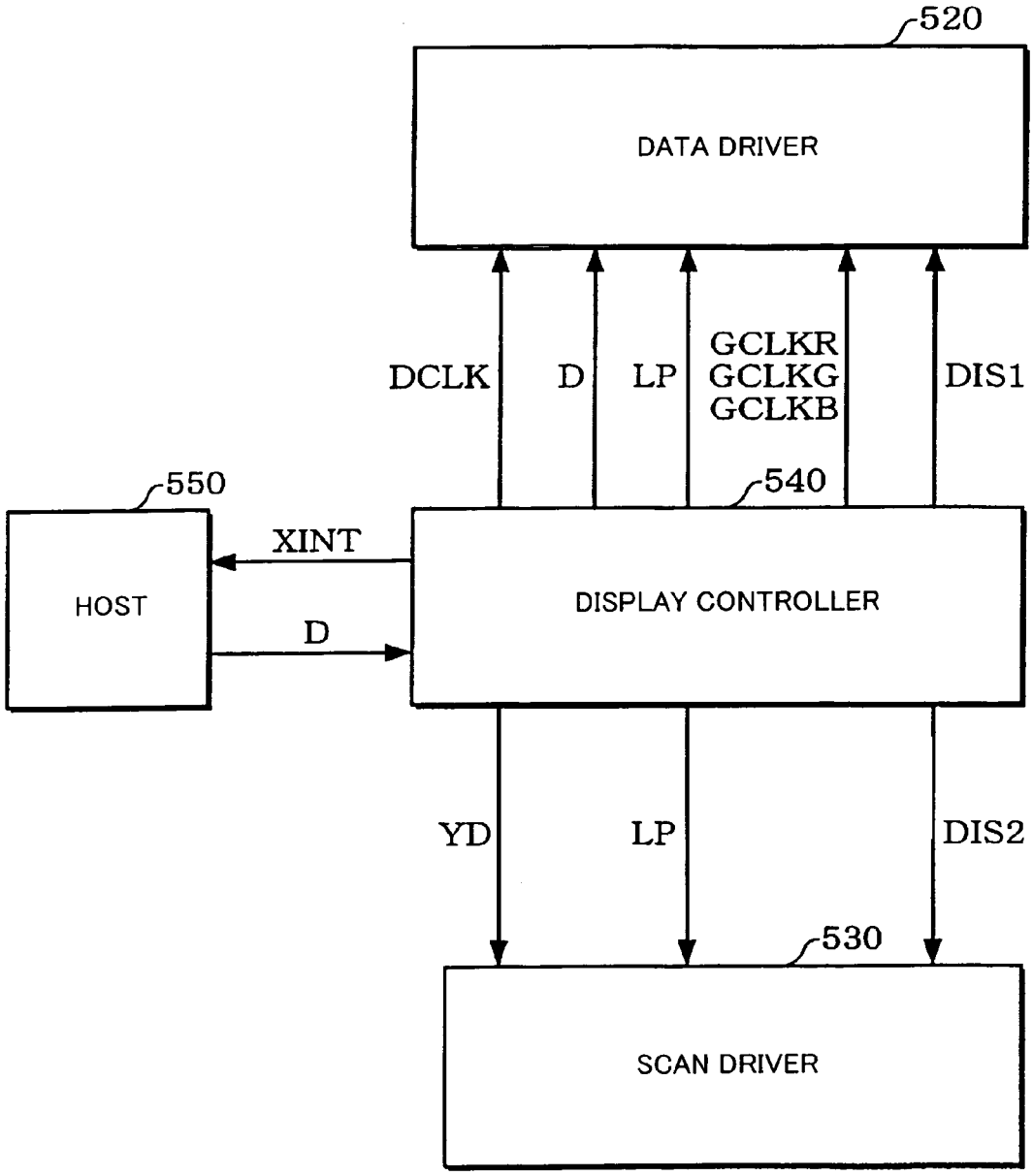
FIG. 7 shows the connection relationship among a display controller, a data driver, a scan driver, and a host according to one embodiment of the present invention.

FIG. 7 shows the connection relationship among the display controller 540, the data driver 520, the scan driver 530, and the host 550 in present embodiment.

The display controller 540 includes a frame memory which stores the grayscale data for at least one vertical scan period (one frame). The grayscale data generated by the host 550 is supplied to the frame memory.

The display controller 540 reads the grayscale data from the frame memory in a predetermined read cycle, and supplies the grayscale data to the data driver 520. The display controller 540 sequentially outputs the R component grayscale data, G component grayscale data, B component grayscale data, R component grayscale data, . . . in four bit units in synchronization with the dot clock signal DCLK. The display controller 540 performs grayscale control using PWM in the horizontal display period within the horizontal scan period by outputting the latch pulse LP, the discharge signal DIS1, and the grayscale clock signals GCLKR to GCLKB to the data driver 520.

The host 550 supplies the grayscale data to the display controller 540 in response to an interrupt signal XINT output from the display controller 540.

The display controller 540 outputs the vertical synchronization signal YD, the latch pulse LP, and the discharge signal DIS2 to the scan driver 530 so that the scan lines are scanned in synchronization with the drive of the data driver 520.

Figure 8:
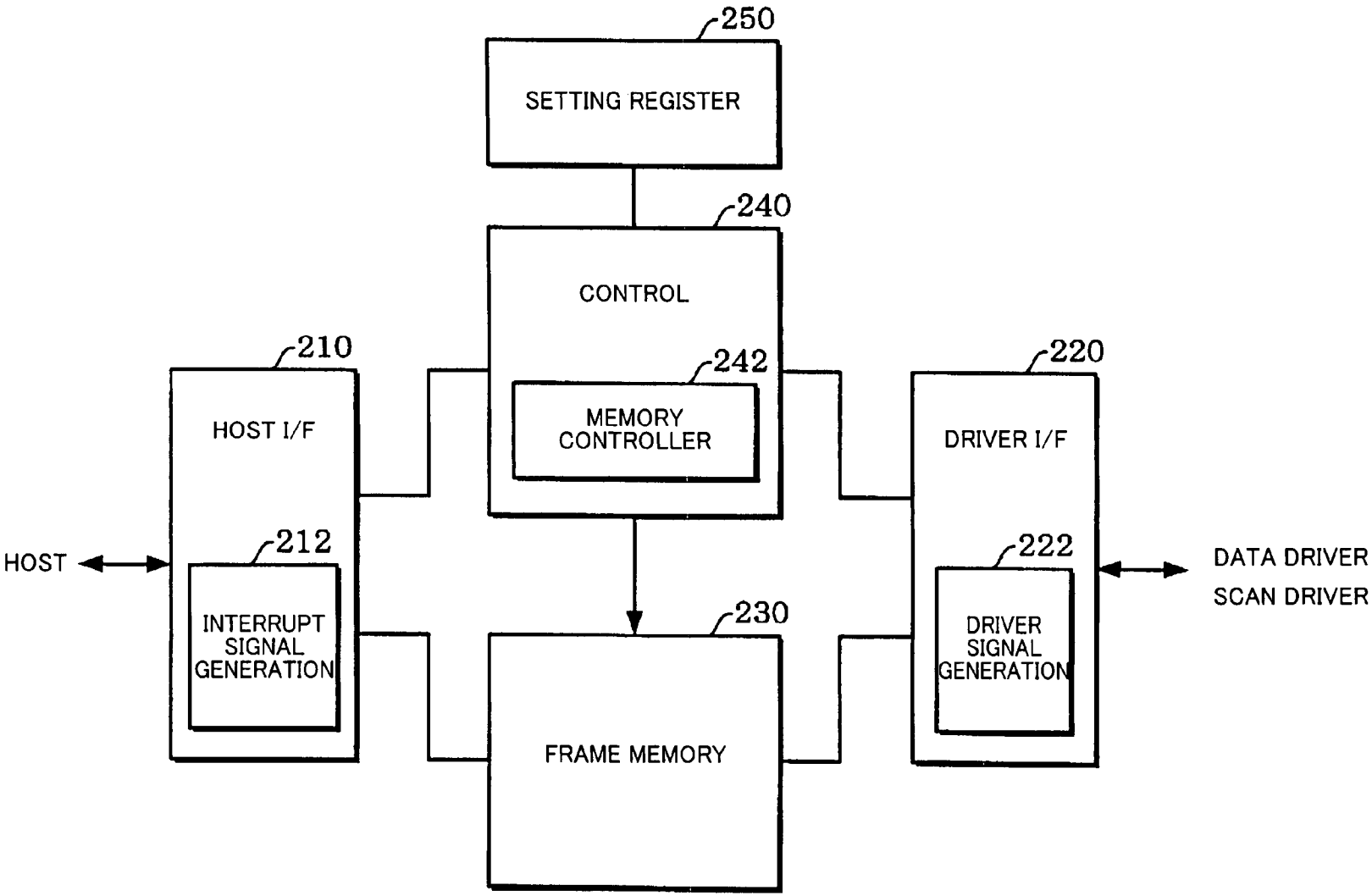
FIG. 8 schematically shows a display controller according to one embodiment of the present invention.

FIG. 8 shows an outline of the display controller 540 in this embodiment.

The display controller 540 includes a host interface (hereinafter abbreviated as "I/F") 210, a driver I/F 220, a frame memory 230, a control section 240, and a setting register section 250.

The host I/F 210 performs interface processing with the host 550. In more detail, the host I/F 210 controls transmission and reception of data and various control signals between the display controller 540 and the host 550. The host I/F 210 includes an interrupt signal generation section 212. The interrupt signal generation section 212 generates the interrupt signal XINT output to the host 550. In more detail, the interrupt signal generation section 212 generates the pulse-output or level-output interrupt signal XINT in one or more cycles of one frame (one vertical scan) period specified by a signal generated by a driver signal generation section 222. The interrupt signal generation section 212 generates the interrupt signal XINT based on a value set in the setting register section 250.

The driver I/F 220 performs interface processing with the data driver 520 and the scan driver 530. In more detail, the driver I/F 220 controls transmission and reception of data and various control signals between the display controller 540 and the data driver 520 and the scan driver 530. The driver I/F 220 includes the driver signal generation section 222 which generates various display control signals transmitted to the data driver 520 and the scan driver 530. The driver signal generation section 222 generates various display control signals based on the value set in the setting register section 250.

The frame memory 230 stores the grayscale data for one frame (for one vertical scan) supplied from the host 550 through the host I/F 210, for example. The value is set in the setting register section 250 by the host 550 through the host I/F 210.

The control section 240 controls the host I/F 210, the driver I/F 220, the frame memory 230, and the setting register section 250.

In the display controller 540, the grayscale data for one frame is read from the frame memory 230 in a predetermined read cycle (every 1/60 sec, for example), and the grayscale data is output to the data driver 520 through the driver I/F 220. Therefore, the write timing of the grayscale data from the host 550 into the frame memory 230 is asynchronous with the read timing of the grayscale data from the frame memory 230 into the data driver 520. The access control of the frame memory 230 is performed by a memory controller 242 in the control section 240.

The grayscale data written into the frame memory 230 is supplied from the host 550 corresponding to the interrupt signal XINT output from the display controller 540.

Figure 9A:
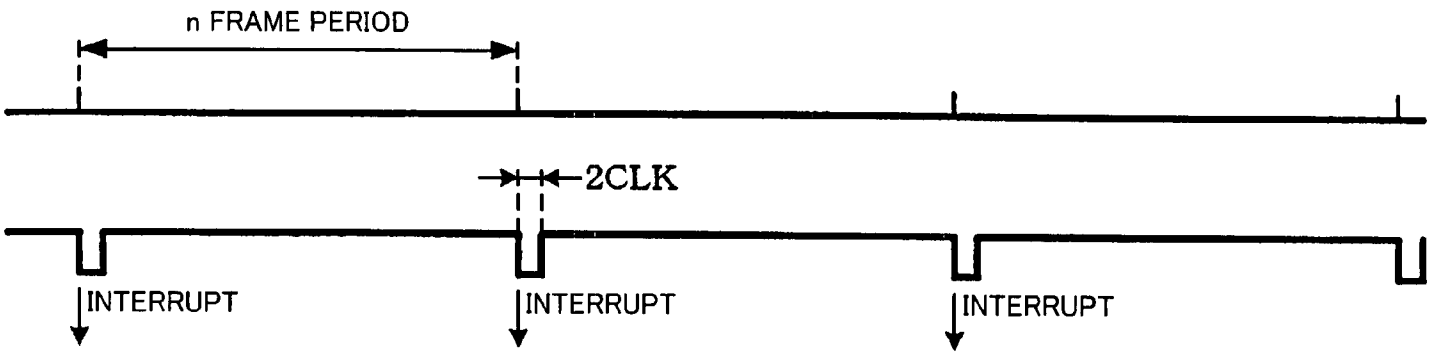
FIGS. 9A and 9B show an interrupt signal according to one embodiment of the present invention.
Figure 9B:
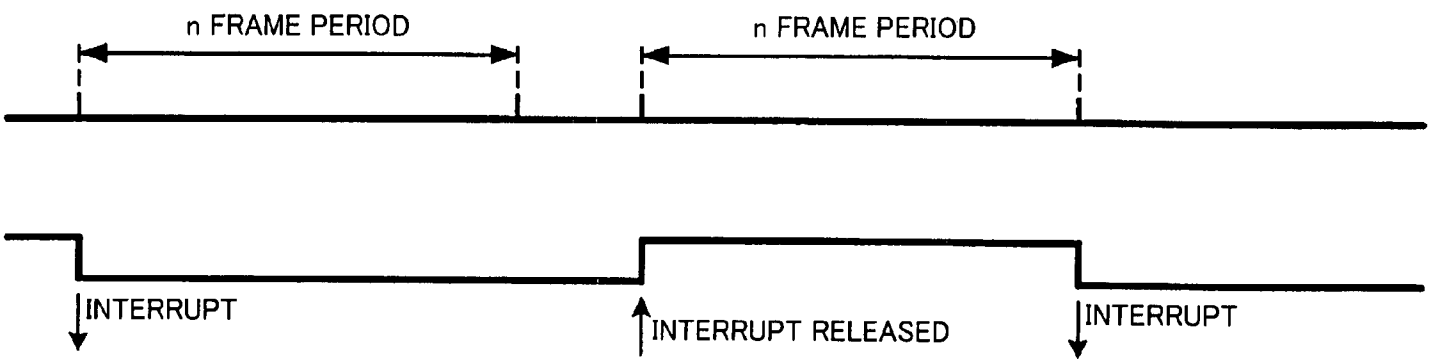

FIGS. 9A and 9B show the interrupt signal XINT in one embodiment of the present invention. The interrupt signal XINT is active at the L level.

FIG. 9A shows the pulse-output interrupt signal XINT. When the interrupt signal XINT is set to be pulse-output, the interrupt signal generation section 212 generates the interrupt signal XINT having pulses which become active in n (n is a positive integer) frame cycle. Each pulse has a width of two clock cycles of the system clock signal CLK, for example.

FIG. 9B shows the level-output interrupt signal XINT. When the interrupt signal XINT is set to be level-output, the interrupt signal generation section 212 generates the interrupt signal XINT which becomes active at the falling edge, is released by the host 550, and again becomes active after an n frame period has elapsed from the release timing.

The frame cycle and pulse-output or level-output setting are set by the host 550.

Figure 10:
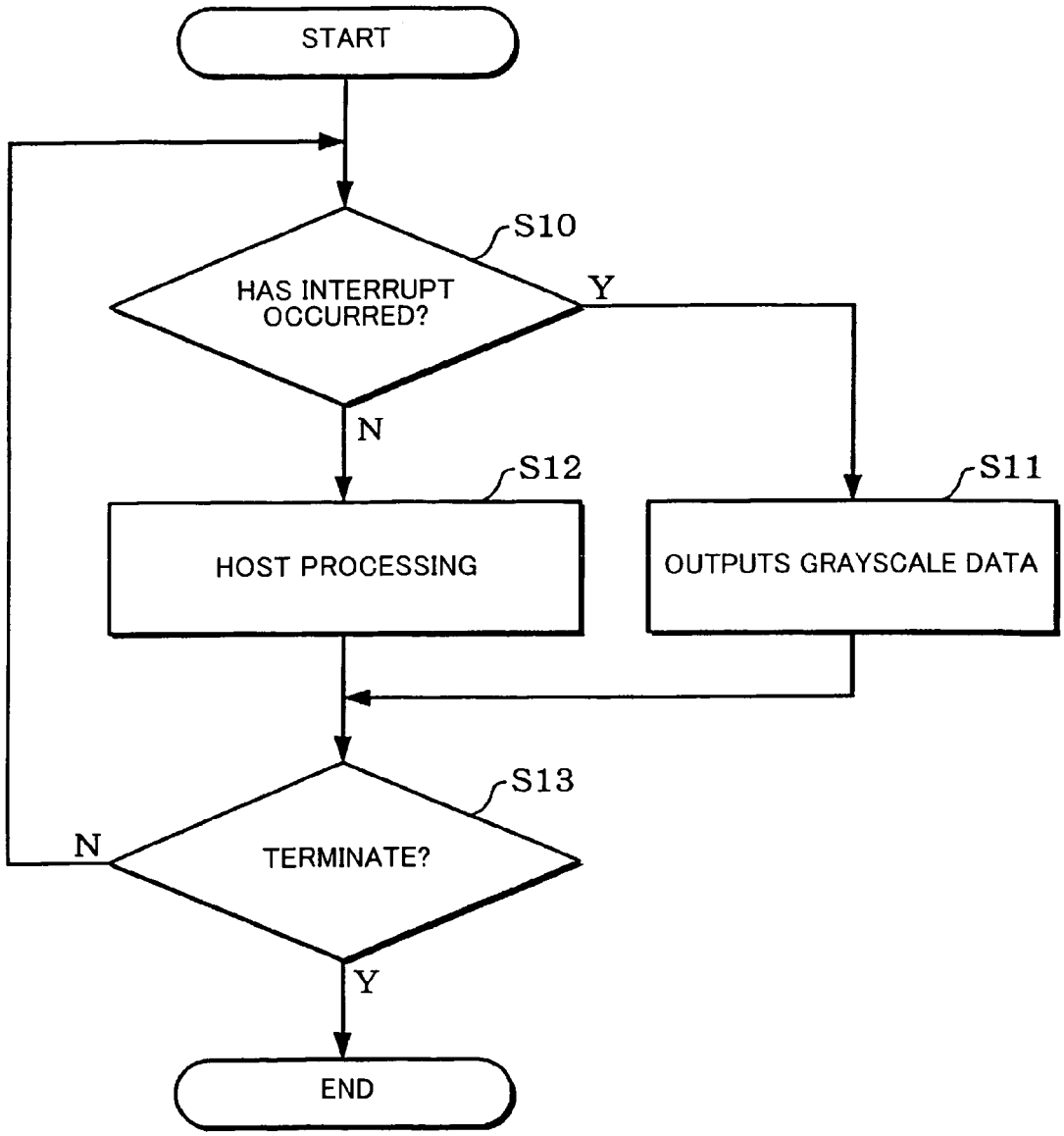
FIG. 10 is a flowchart showing an example of interrupt processing of a host.

FIG. 10 shows a flow of an example of interrupt processing of the host 550. A program for executing the processing shown in FIG. 10 is stored in a memory (not shown) of the host 550, and a CPU (not shown) of the host 550 executes the processing according to the program.

The host 550 detects whether or not an interrupt has occurred by judging whether or not the interrupt signal XINT which has become active has been input (step S10).

When occurrence of an interrupt has been detected (step S10: Y), the host 550 outputs the grayscale data to the display controller 540 (step S11). The display controller 540 which has received the grayscale data from the host 550 through the host I/F 210 writes the grayscale data into the frame memory 230 using the memory controller 242 asynchronously with the read control of the frame memory 230.

When occurrence of an interrupt has not been detected in the step S10 (step S10: N), the host 550 executes predetermined host processing (step S12). Therefore, it is unnecessary for the host 550 to monitor the timing for supplying the grayscale data to the display controller 540, whereby the host 550 can use the saved processing performance for another processing.

When the processing is terminated on a predetermined finish condition after execution of the host processing in the step S12 or after output of the grayscale data in the step S11 (step S13: Y), a series of processing is terminated (END). When the processing is not terminated in the step S13 (step S13: N), the processing is returned to the step S10.

The interrupt signal XINT which functions as a trigger for performing the above-described interrupt processing is output based on the value set in the setting register section 250.

Figure 11:
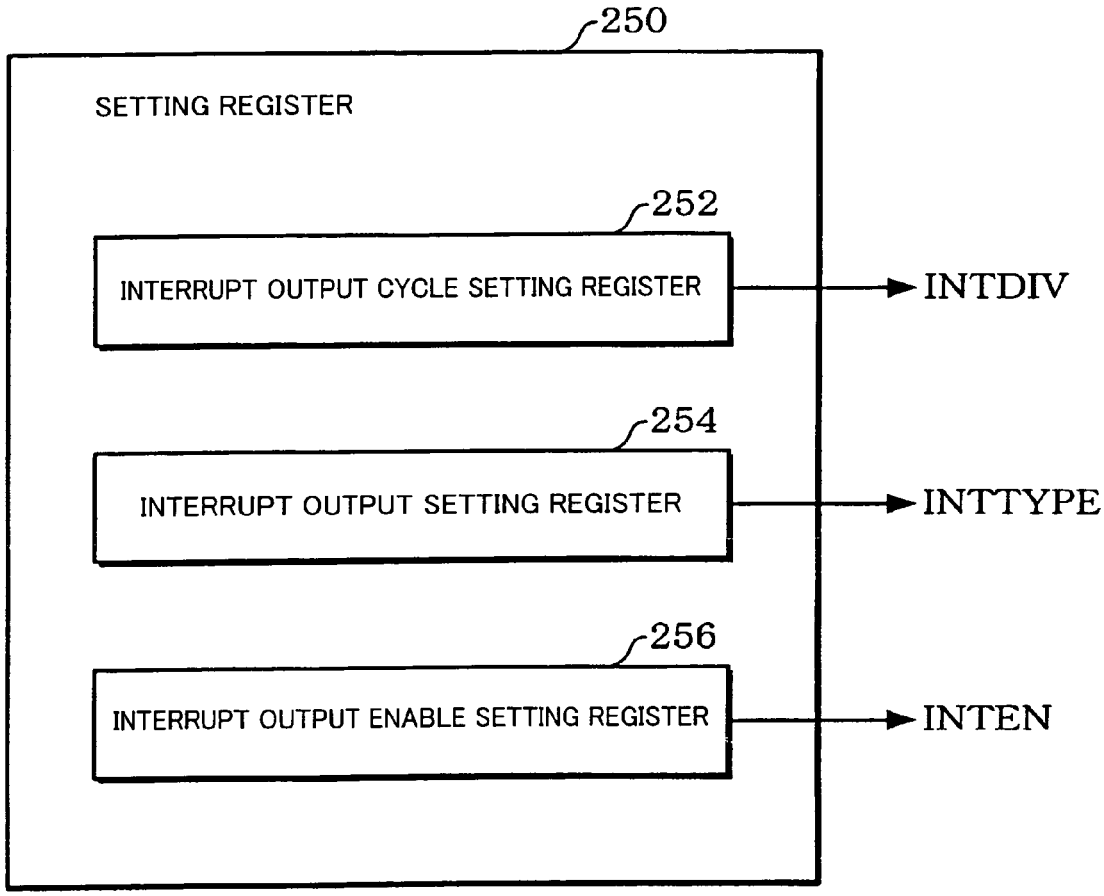
FIG. 11 shows the setting register section shown in FIG. 8.

FIG. 11 shows the setting register section 250.

The setting register section 250 includes an interrupt output cycle setting register 252. An output cycle INTDIV of the interrupt signal XINT is set in the interrupt output cycle setting register 252. In more detail, the output cycle of the interrupt signal XINT is set in the interrupt output cycle setting register 252 in units of one vertical scan period.

The setting register section 250 may further include an interrupt output setting register 254. Data INTTYPE for selecting whether to pulse-output or level-output the interrupt signal XINT is set in the interrupt output setting register 254. When the data INTTYPE indicates "pulse output", the interrupt signal generation section 212 outputs the pulse-output interrupt signal XINT as shown in FIG. 9A. When the data INTTYPE indicates "level output", the interrupt signal generation section 212 outputs the level-output interrupt signal XINT as shown in FIG. 9B.

The setting register section 250 may further include an interrupt output enable setting register 256. Data INTEN for selecting whether to enable or disable the interrupt signal XINT is set in the interrupt output enable setting register 256. When the data INTEN indicates "enable", the interrupt signal generation section 212 outputs the interrupt signal XINT which becomes active in a predetermined cycle. When the data INTEN indicates "disable", the interrupt signal generation section 212 masks the output of the interrupt signal XINT to set the interrupt signal XINT in an inactive state.

As described above, the display controller 540 in this embodiment includes the frame memory 230, the interrupt output cycle setting register 252, and the interrupt signal generation section 212. The display data for at least one vertical scan period supplied from the host 550 is stored in the frame memory 230. The interrupt signal generation section 212 outputs a pulse-output interrupt signal (first interrupt signal) having pulses in the output cycle set in the interrupt output cycle setting register 252 to the host 550 as the interrupt signal XINT. The display controller 540 stores the display data supplied from the host 550 corresponding to the interrupt signal XINT in the frame memory 230, reads the display data from the frame memory 230 in a predetermined read cycle, and supplies the display data to the data driver 520.

The interrupt signal generation section 212 may generate a level-output interrupt signal (second interrupt signal) which becomes active in the output cycle set in the interrupt output cycle setting register 252 and is released by the host 550, and may output the pulse-output or level-output interrupt signal (first or second interrupt signal) to the host 550 as the interrupt signal XINT based on the value set in the interrupt output setting register 254. In this case, the interrupt signal generation section 212 may generate the level-output interrupt signal (second interrupt signal) which becomes active when the output cycle set in the interrupt output cycle setting register 252 has elapsed after the release timing of the host 550.

The interrupt signal generation section 212 may output the interrupt signal XINT which periodically becomes active to the host 550 when the interrupt signal XINT is enabled in the interrupt output enable setting register 256, and may mask the output of the interrupt signal when the interrupt signal XINT is disabled in the interrupt output enable setting register 256.

When the read cycle from the frame memory 230 is a period longer than one vertical scan period, it is difficult to write the display data into the frame memory 230 in vertical scan period units. In this case, the host 550 need not count the number of frames display-controlled by the data driver 520 and the scan driver 530, whereby the processing load imposed on the host 550 can be reduced. Moreover, since it suffices that the host 550 merely output the grayscale data in response to the interrupt signal XINT asynchronously with the grayscale data read control of the display controller 540, the control can be simplified.

The essential sections of the display controller 540 are described below.

2.1 Driver Signal Generation Section

Figure 12:
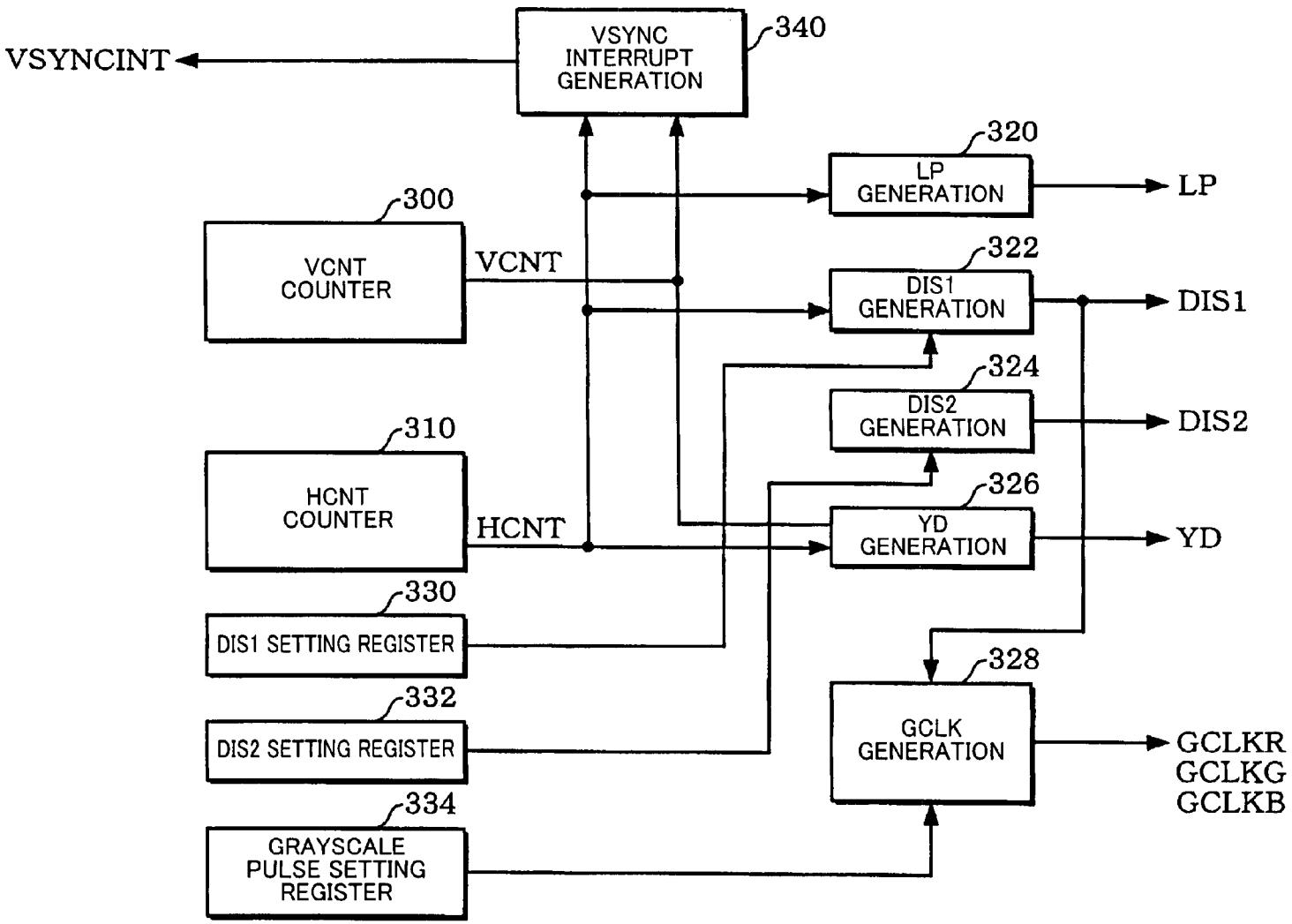
FIG. 12 shows the driver signal generation section shown in FIG. 8.

FIG. 12 shows the driver signal generation section 222.

The driver signal generation section 222 includes a VCNT counter 300 and an HCNT counter 310, and generates the display control signals such as the latch pulse LP based on count values of the VCNT counter 300 and the HCNT counter 310.

The VCNT counter 300 is a counter which decrements the count value in units of one horizontal scan period. The initial value of the count value of the VCNT counter 300 is loaded each time one vertical scan period starts.

The HCNT counter 310 is a counter which decrements the count value in units of the dot clock signal DCLK. The initial value of the count value of the HCNT counter 310 is loaded each time one horizontal scan period starts.

The driver signal generation section 222 further includes an LP generation section 320, a DIS1 generation section 322, a DIS2 generation section 324, a YD generation section 326, and a GCLK generation section 328. The LP generation section 320 generates the latch pulse LP. The DIS1 generation section 322 generates the discharge signal DIS1. The DIS2 generation section 324 generates the discharge signal DIS2. The GCLK generation section 328 generates the grayscale clock signals GCLKR to GCLKB.

The driver signal generation section 222 can set the falling timings of the discharge signals DIS1 and DIS2. Therefore, the driver signal generation section 222 can generate the discharge signals DIS1 and DIS2 based on the values set in a DIS1 setting register 330 and a DIS2 setting register 332.

The driver signal generation section 222 can set the timing of the edge of each of N (N is an integer of two or more) grayscale pulses of the grayscale clock signal within the horizontal display period. Therefore, the GCLK generation section 328 generates the grayscale clock signals GCLKR to GCLKB of which the edge of each grayscale pulse is set based on the value set in the grayscale pulse setting register 334.

In the case where the display controller 540 includes the DIS1 setting register 330, the DIS2 setting register 332, and the grayscale pulse setting register 334, these registers are included in the setting register section 250.

Figure 13:
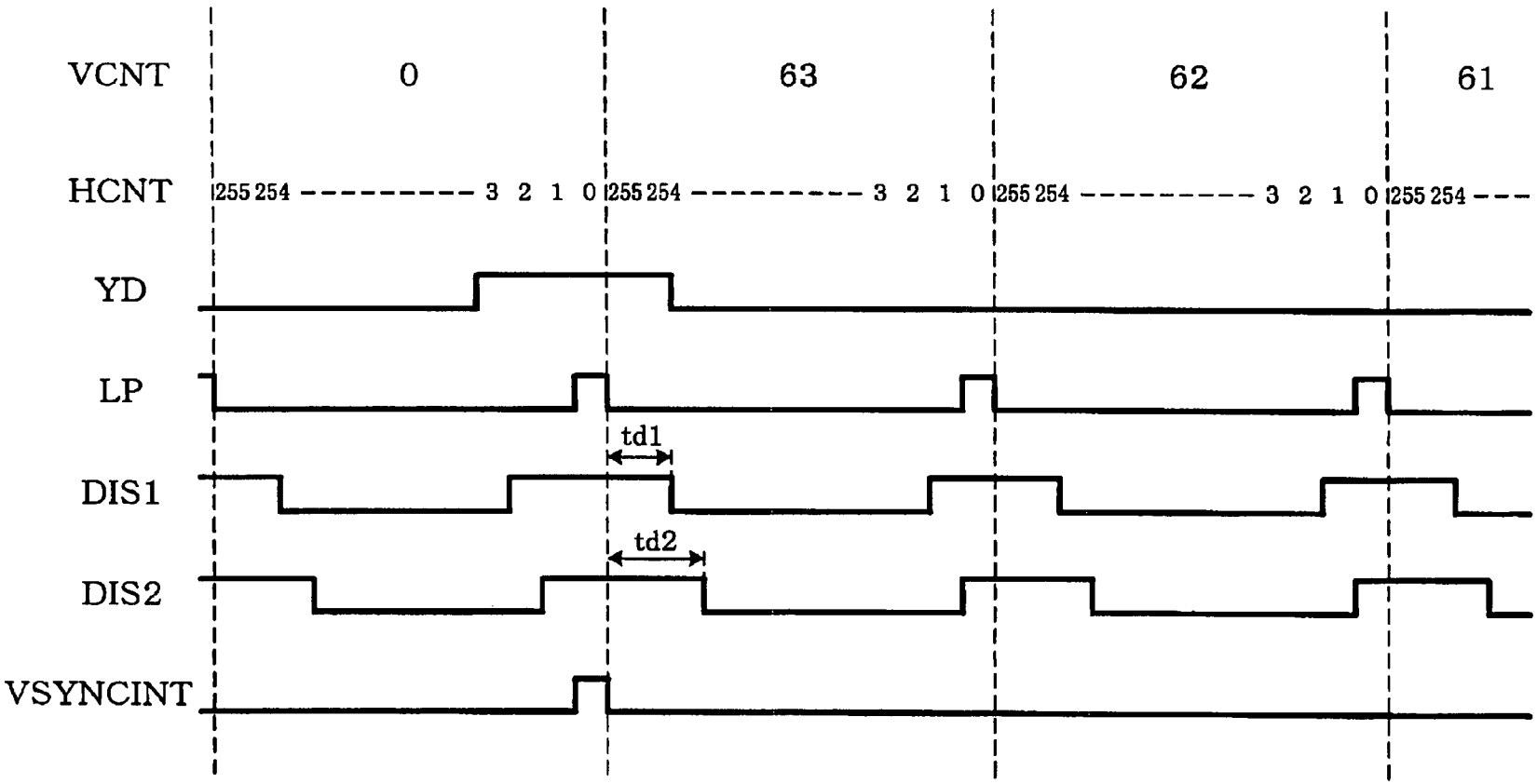
FIG. 13 is a timing chart of an operation example of a driver signal generation section.

FIG. 13 is a timing chart of an operation example of the driver signal generation section 222. In FIG. 13, the number of scan lines is 64, and one horizontal scan period is 256 pixels.

The LP generation section 320 generates the latch pulse LP which is set at the H level when the count value HCNT of the HCNT counter 310 is "0".

The discharge signal DIS1 generated by the DIS1 generation section 322 is changed to the H level when the count value of the HCNT counter 310 is a predetermined value ("2", for example), and is changed to the L level when a period td1 ("2", for example) set in the DIS1 setting register 330 has elapsed after the next horizontal scan period has started.

The discharge signal DIS2 generated by the DIS2 generation section 324 is changed to the H level when the count value of the HCNT counter 310 is a predetermined value ("1", for example), and is changed to the L level when a period td2 ("3", for example) set in the DIS2 setting register 332 has elapsed after the next horizontal scan period has started.

The vertical synchronization signal YD generated by the YD generation section 326 is changed to the H level when the count value VCNT of the VCNT counter 300 is "0" and the count value HCNT of the HCNT counter 310 is a predetermined value ("3", for example), and is changed to the L level in the next vertical scan period when a predetermined value ("2", for example) has elapsed within the first horizontal scan period.

The driver signal generation section 222 includes a VSYNC interrupt generation section 340. The VSYNC interrupt generation section 340 generates a VSYNC interrupt signal VSYNCINT which is set at the H level when the count value VCNT of the VCNT counter 300 is "0" and the count value HCNT of the HCNT counter 310 is "0". The VSYNC interrupt signal VSYNCINT is output to the interrupt signal generation section 212.

Figure 14:
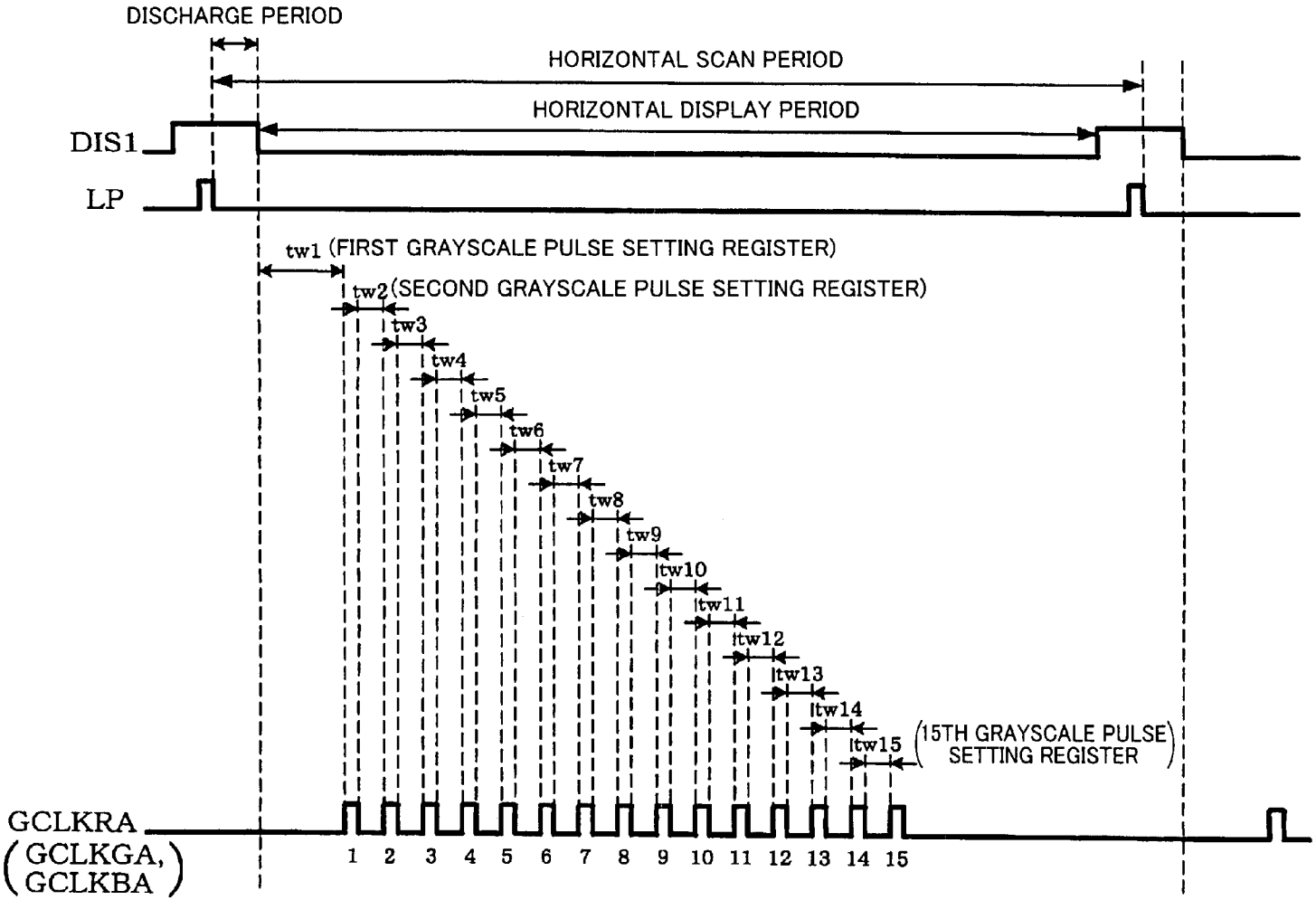
FIG. 14 shows a grayscale clock signal generated by a GCLK generation section.

FIG. 14 shows the grayscale clock signal generated by the GCLK generation section 328. FIG. 14 shows the R component grayscale clock signal GCLKR when N is "15". However, the same description also applies to the case where N is another value or the color component is another color component.

The data for setting the edge timing of each of 15 grayscale pulses (first to fifteenth grayscale pulses) of the R component grayscale clock signal GCLKR, 15 grayscale pulses (first to fifteenth grayscale pulses) of the G component grayscale clock signal GCLKQ and 15 grayscale pulses (first to fifteenth grayscale pulses) of the B component grayscale clock signal GCLKB is set in the grayscale pulse setting register 334 shown in FIG. 12.

The grayscale pulse setting register 334 includes first to fifteenth grayscale pulse setting registers (not shown) for each color component. The first grayscale pulse setting register is a register for setting an interval tw1 between a reference timing as the starting point of the horizontal display period and the edge (rising edge or falling edge) of the first grayscale pulse. The second grayscale pulse setting register is a register for setting an interval tw2 between the edge of the first grayscale pulse and the edge of the second grayscale pulse. Specifically, the ith ($2 \leqq i \leqq N$, i is an integer) grayscale pulse setting register is a register for setting an interval tw1 between the edge of the (i-1)th grayscale pulse and the edge of the ith grayscale pulse.

Figure 15:
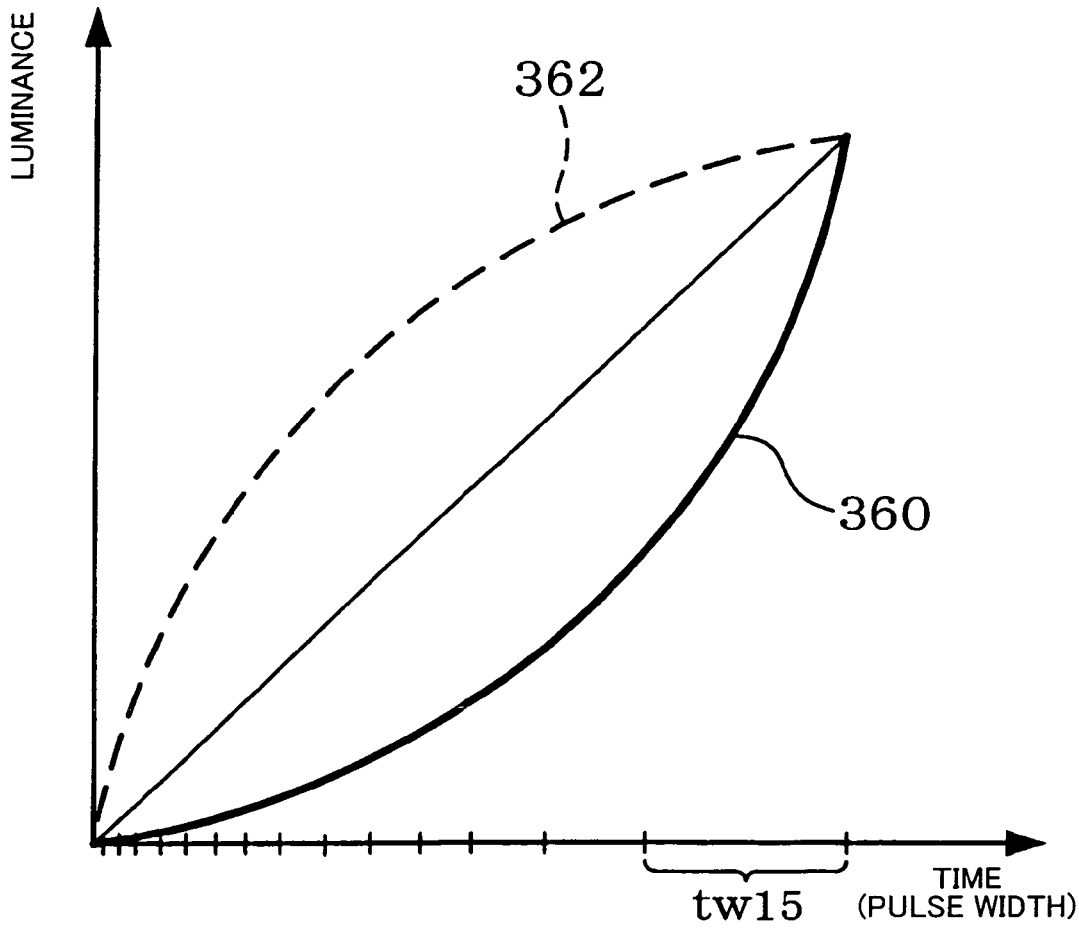
FIG. 15 shows an example of organic EL grayscale characteristics.

As described above, since the GCLK generation section 328 can separately set the timing of the edge of each grayscale pulse of the grayscale clock signal GCLK for specifying the change point of the PWM signal, gamma correction which corrects a characteristic curve 360 of the organic EL panel 510 as shown in FIG. 15 is realized, whereby the organic EL panel 510 can be finely controlled so that characteristics such as a gamma correction curve 362 are obtained. According to the characteristic diagram shown in FIG. 15, it is necessary to increase the interval between the grayscale pulses (pulse width of the grayscale clock signal) as the luminance is increased in order to obtain the luminance (grayscale) specified by the discrete grayscale data.

Since the grayscale clock signals GCLKR to GCLKB, of which the interval between the grayscale pulses can be set, can be generated for each color component, the pulse width of the PWM signal can be caused to differ even if the value of the grayscale data is the same. This enables a desired grayscale representation to be realized by performing fine gamma correction for each color component, even if the luminance differs to a large extent between each color component of the organic EL panel 510. Since the manufacturing technology of the organic EL panel is immature, differing from the liquid crystal panel, and the difference between each color component is large, it is particularly effective that fine gamma correction can be realized for each color component.

Figure 16:
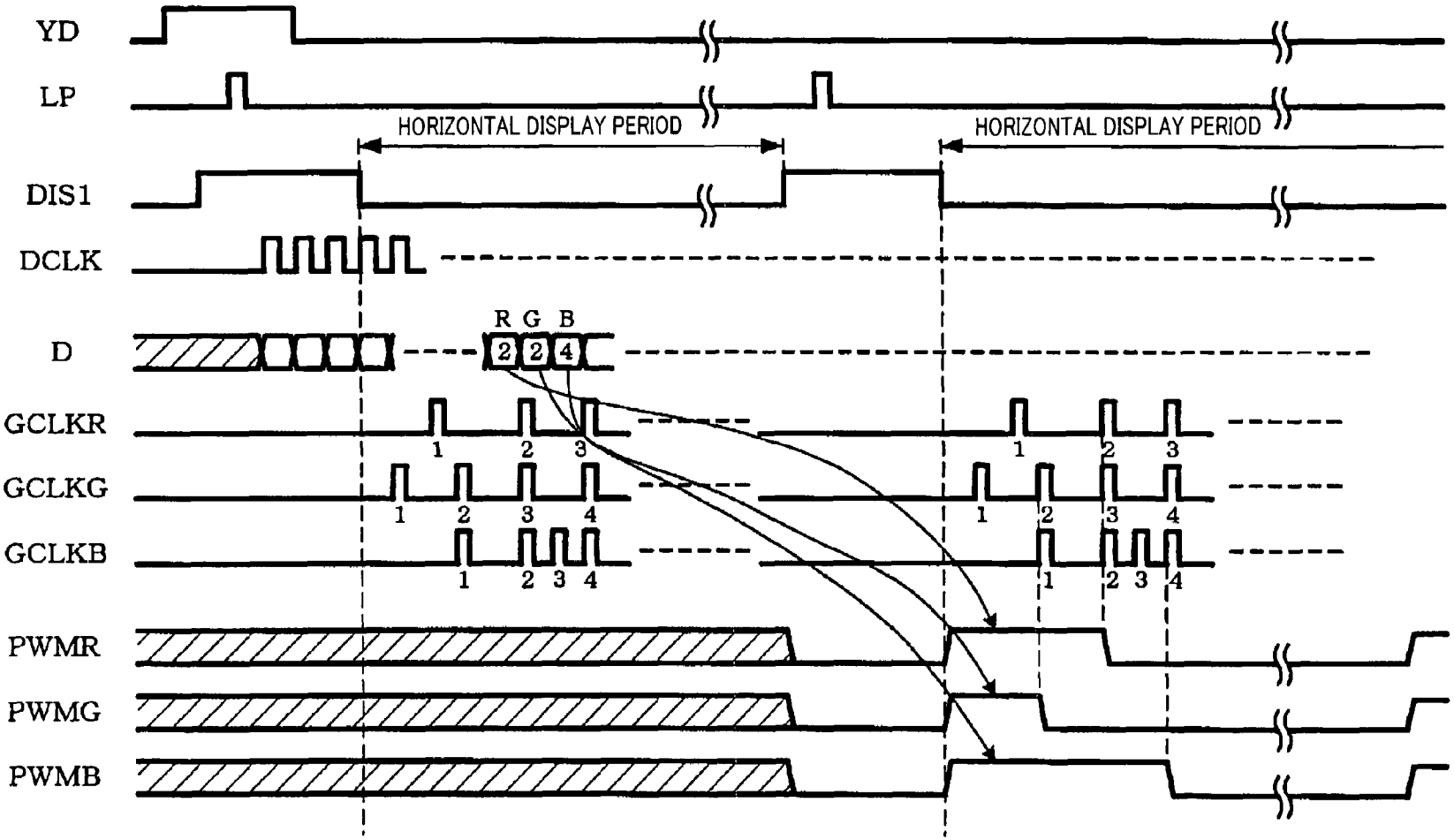
FIG. 16 is a timing chart of an operation example of generating PWM signals by using the grayscale clock signals shown in FIG. 14.

FIG. 16 is a timing chart of an operation example of generating the PWM signals using the grayscale clock signals GCLKR to GCLKB shown in FIG. 14.

One vertical scan period starts when the pulse of the vertical synchronization signal YD is input from the display controller 540. One horizontal scan period starts when the pulse of the horizontal synchronization signal LP is input from the display controller 540 in a period in which the vertical synchronization signal YD is set at the H level. The horizontal display period starts at the timing at which the discharge signal DIS1 from the display controller 540 is changed from the H level to the L level as the reference timing. The horizontal display period ends at the timing at which the discharge signal DIS1 is changed to the H level.

In the horizontal display period, the display controller 540 outputs the dot clock signal DCLK and sequentially outputs the color component grayscale data in synchronization with the dot clock signal DCLK. The GCLK generation section 320 outputs the grayscale clock signals GCLKR, GCLKG, and GCLKB within the horizontal display period based on the grayscale pulse setting register 334.

The data driver 520, which has stored the grayscale data from the display controller 540 in the shift register, latches the grayscale data in one horizontal scan unit in the line latch based on the horizontal synchronization signal LP in a period in which the discharge signal DIS1 is set at the H level. Therefore, the data driver 520 generates the PWM signals PWMR, PWMG, and PWMB corresponding to the grayscale data in the horizontal scan period subsequent to the horizontal scan period in which the grayscale data from the display controller 540 is supplied. In FIG. 16, since the R component grayscale data is "2", the pulse width of the PWM signal PWMR is a period from the falling edge of the discharge signal DIS1 to the edge of the second grayscale pulse. Since the G component grayscale data is "2", the pulse width of the PWM signal PWMG is a period from the falling edge of the discharge signal DIS1 to the edge of the second grayscale pulse. Since the B component grayscale data is "4", the pulse width of the PWM signal PWMB is a period from the falling edge of the discharge signal DIS1 to the edge of the fourth grayscale pulse. As described above, since the interval between the grayscale pulses of the grayscale clock signal can be caused to differ for each color component, the PWM signals having different pulse widths can be generated for the color components of which the value of the grayscale data is the same.

Moreover, the horizontal display period is made variable by adjusting the horizontal blanking period using the discharge signal DIS1, and the interval between the grayscale pulses can be caused to differ within the horizontal display period. This enables the pulse width of the PWM signal to be set as the absolute value corresponding to the size of the organic EL panel 510 and the type of the organic EL element, whereby a desired grayscale representation can be easily achieved.

FIG. 16 shows the case where the interval between the reference timing and the grayscale pulse or the interval between the grayscale pulses is set at the rising edge of the grayscale pulse. However, the interval may be set at the falling edge of the grayscale pulse.

2.2. Interrupt Signal Generation Section

Figure 17:
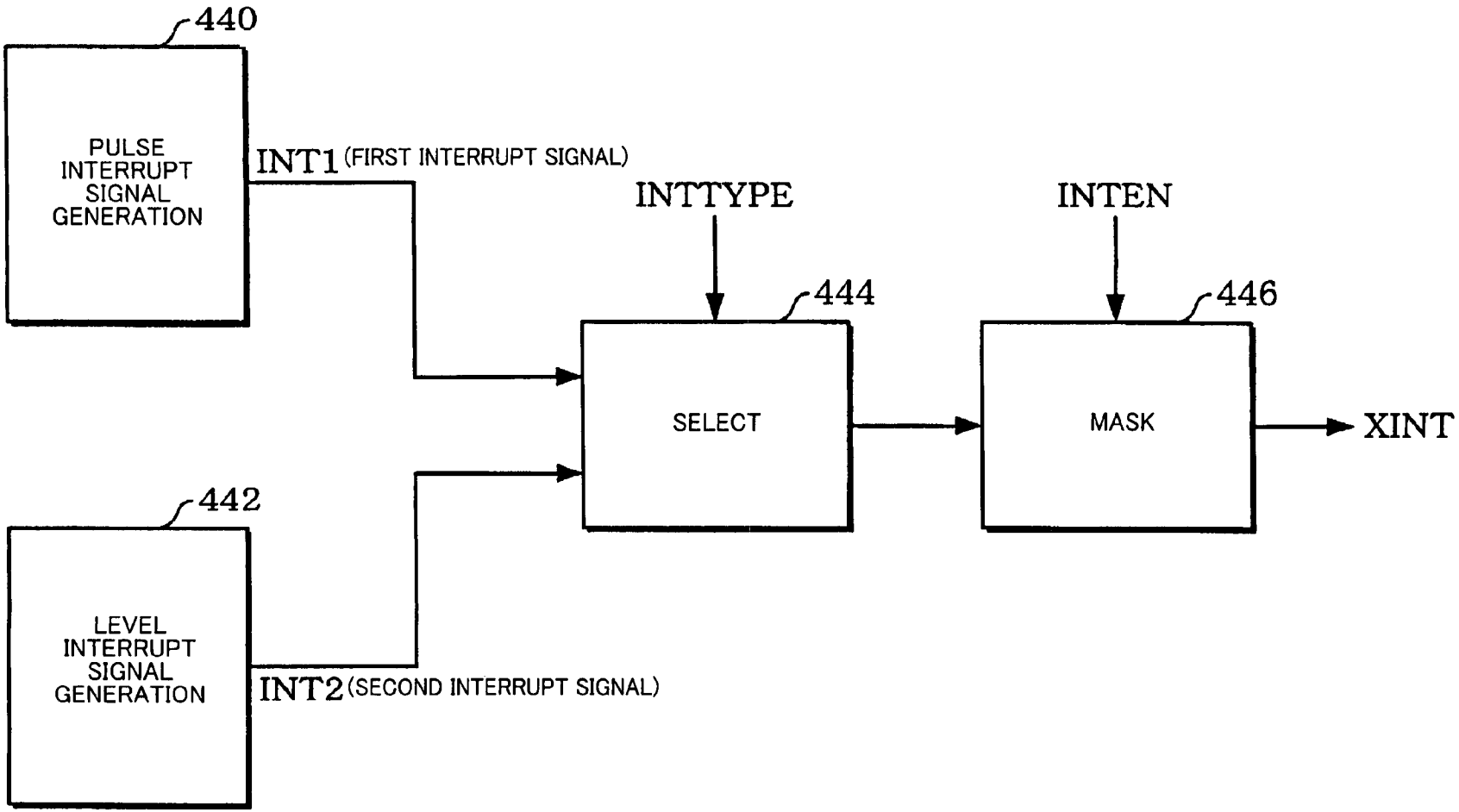
FIG. 17 shows the interrupt signal generation section shown in FIG. 8.

FIG. 17 shows the interrupt signal generation section 212 shown in FIG. 8.

The interrupt signal generation section 212 includes a pulse interrupt signal generation section 440, a level interrupt signal generation section 442, a select section 444, and a mask section 446.

The pulse interrupt signal generation section 440 generates a pulse-output interrupt signal INT1 as the first interrupt signal. The level interrupt signal generation section 442 generates a level-output interrupt signal INT2 as the second interrupt signal.

The select section 444 outputs the pulse-output interrupt signal INT1 or the level-output interrupt signal INT2 based on the data INTTYPE set in the interrupt output setting register 254. When the data INTTYPE indicates "pulse output", the select section 444 outputs the pulse-output interrupt signal INT1 as the interrupt signal. When the data INTTYPE indicates "level output", the select section 444 outputs the level-output interrupt signal INT2 as the interrupt signal.

The mask section 446 masks the output from the select section 444 based on the data INTEN set in the interrupt output enable setting register 256. When the set data INTEN indicates "enable", the mask section 446 outputs the output from the select section 444 as the interrupt signal XINT. When the set data INTEN indicates "disable", the mask section 446 performs mask processing of the output from the select section 444, and outputs the interrupt signal XINT fixed at the H level.

Figure 18:
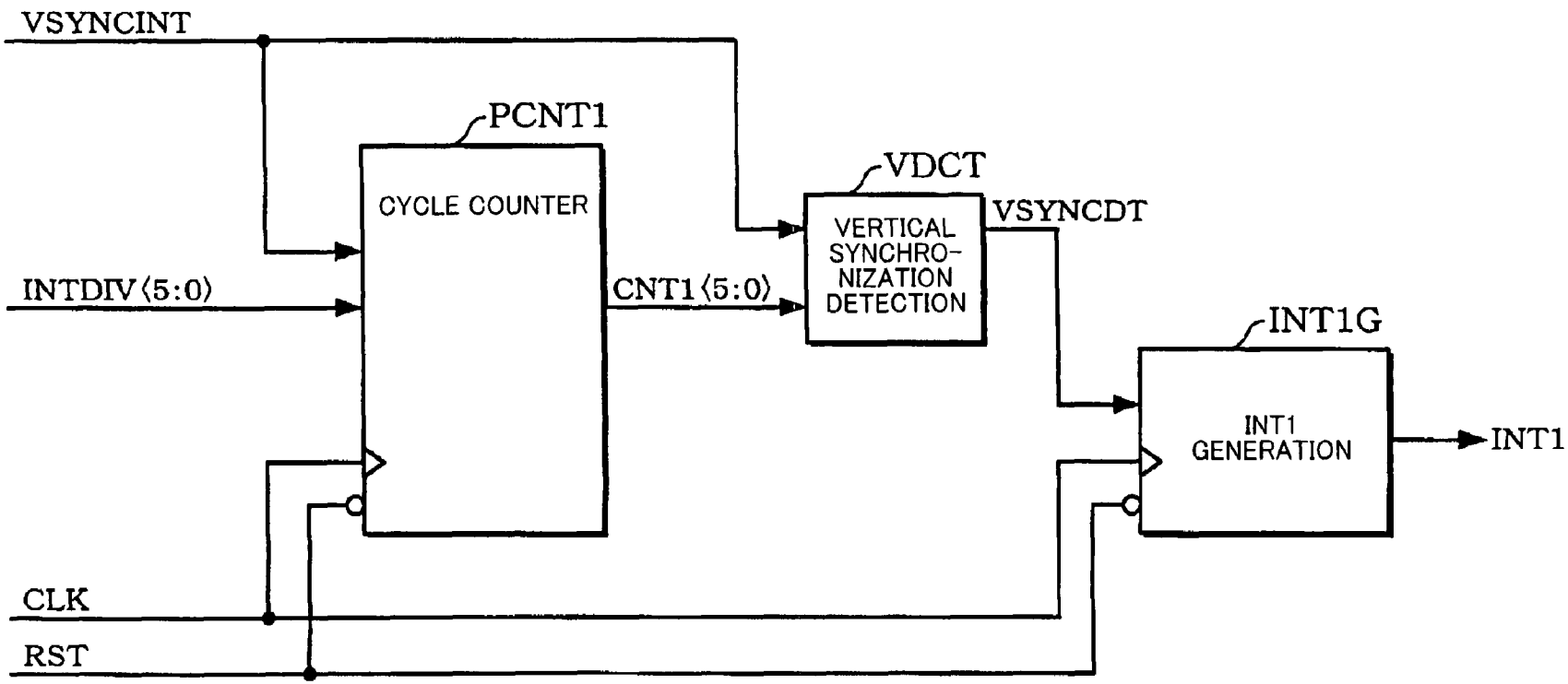
FIG. 18 shows the pulse interrupt signal generation section shown in FIG. 17.

FIG. 18 shows the pulse interrupt signal generation section 440.

FIG. 19A shows a table illustrative of an operation of a cycle counter PCNT1. FIG. 19B shows a table illustrative of an operation of a vertical synchronization detection section VDCT.

As shown in FIG. 19A, the cycle counter PCNT1 shown in FIG. 18 is internally initialized when an initialization signal RST is set to "0" (L level). The data INTDIV<5:0> set in the interrupt output cycle setting register 252 is set in the cycle counter PCNT1 when the initialization signal RST is "1" (H level), the system clock signal CLK is at the rising edge, the VSYNC interrupt signal VSYNCINT is set at the H level, and the count value CNT1<5:0> of the cycle counter PCNT1 is "0". The VSYNC interrupt signal VSYNCINT is generated by the VSYNC interrupt generation section 340 shown in FIG. 12.

The cycle counter PCNT1 decrements the count value CNT1<5:0> when the initialization signal RST is "1" (H level), the system clock signal CLK is at the rising edge, and the VSYNC interrupt signal VSYNCINT is set at the H level on condition that the count value CNT1<5:0> is not "0". As described above, the cycle counter PCNT1 outputs the count value CNT1<5:0> which is decremented each time the VSYNC interrupt signal VSYNCINT becomes active.

As shown in FIG. 19B, the vertical synchronization detection section VDCT shown in FIG. 18 sets a vertical synchronization detection signal VSYNCDCT at the H level (1) when the VSYNC interrupt signal VSYNCINT is set at the H level and the count value CNT1<5:0> output from the cycle counter PCNT1 is "0".

Figure 20:
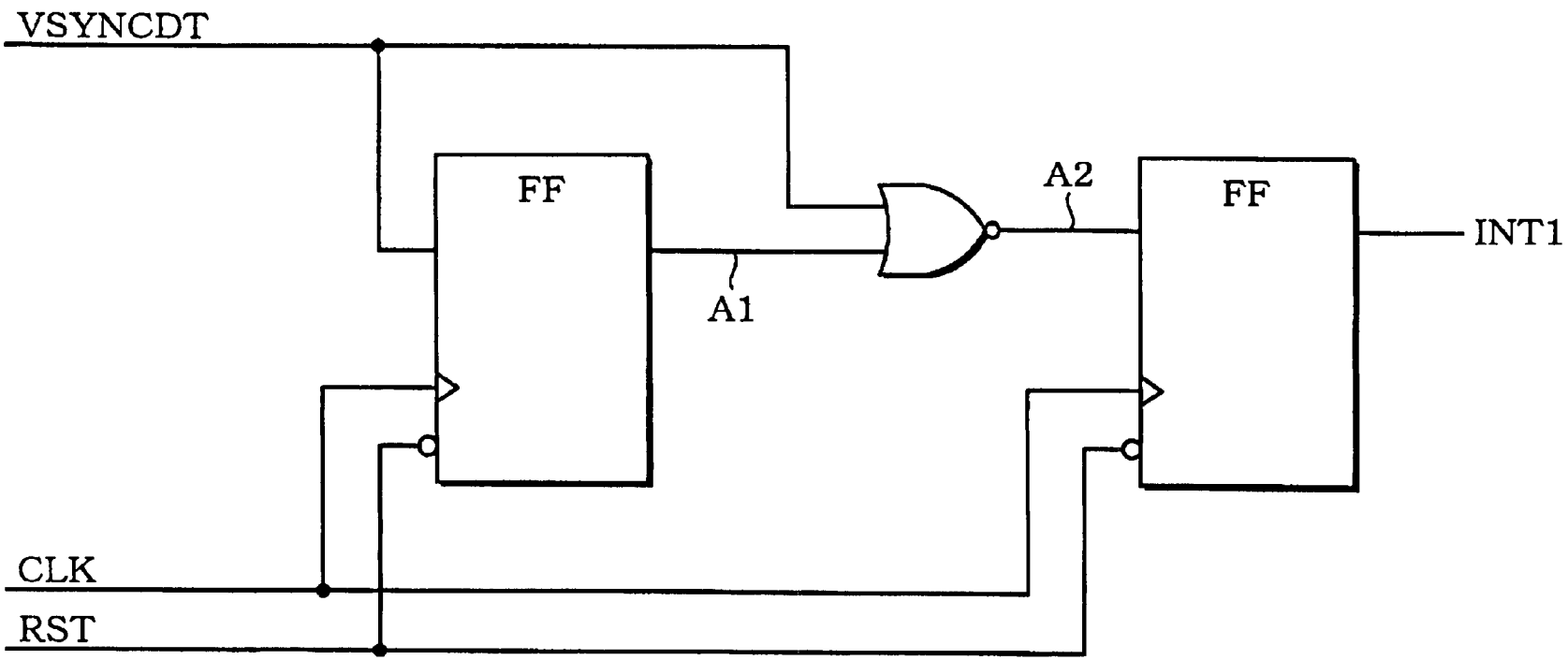
FIG. 20 shows the INT1 generation section shown in FIG. 18.

FIG. 20 shows an INT1 generation section INT1G shown in FIG. 18.

Figure 21:
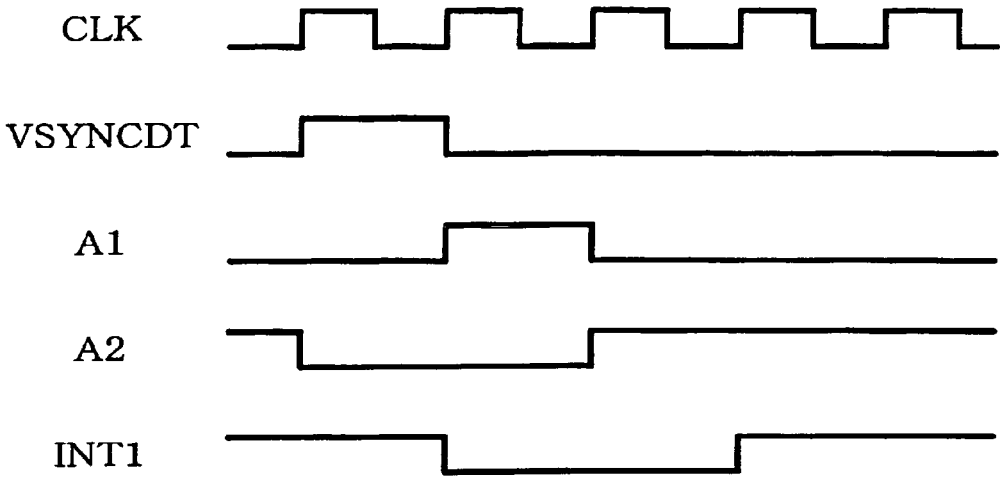
FIG. 21 is a timing chart showing an operation example of the INT1 generation section shown in FIG. 20.

FIG. 21 is a timing chart showing an operation example of the INT1 generation section INT1G shown in FIG. 20.

The INT1 generation section INT1G receives the vertical synchronization detection signal VSYNCDCT output from the vertical synchronization detection section VDCT shown in FIG. 18, and generates the pulse-output interrupt signal INT1. As shown in FIG. 20, the INT1 generation section INT1G includes two flip-flops. As shown in FIG. 21, when the vertical synchronization detection signal VSYNCDCT having a pulse width of one clock cycle of the system clock signal CLK is input, the INT1 generation section INT1G generates the pulse-output interrupt signal INT1 which has a pulse width of two clock cycles of the system clock signal CLK and is active at the L level.

Figure 22:
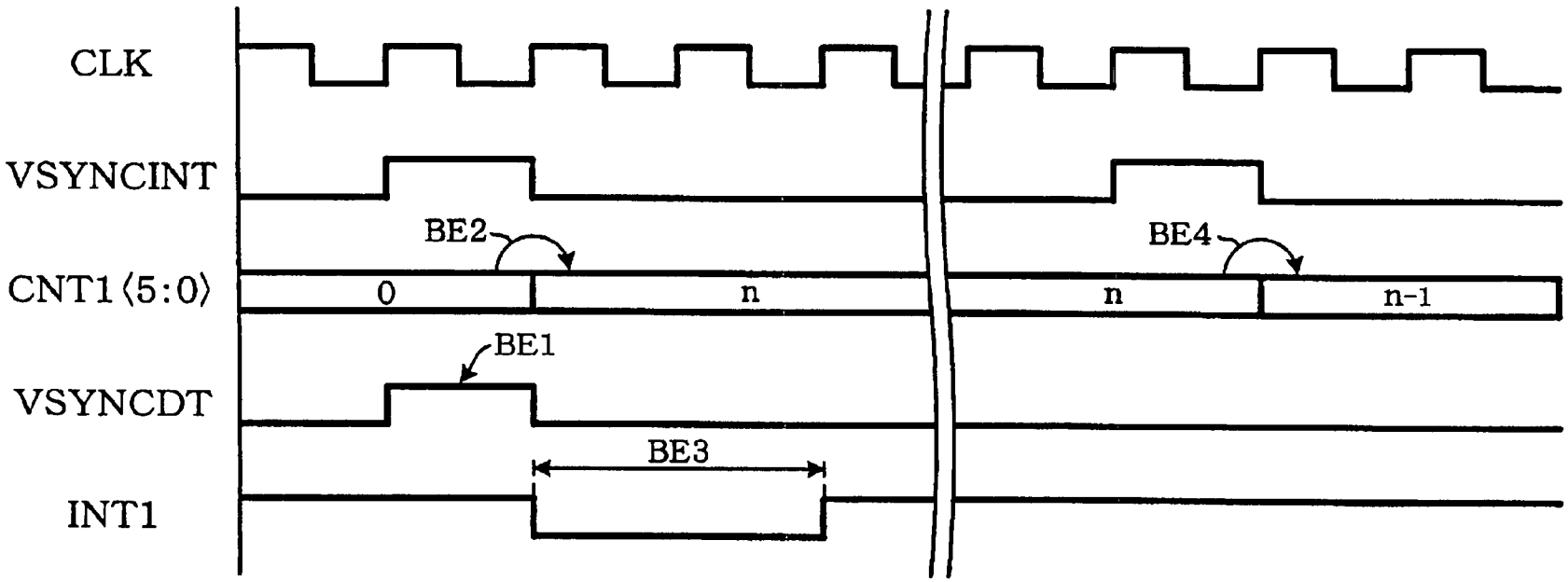
FIG. 22 is a timing chart showing an operation example of the pulse interrupt signal generation section shown in FIG. 18.

FIG. 22 is a timing chart showing an operation example of the pulse interrupt signal generation section 440 shown in FIG. 18. The vertical synchronization detection signal VSYNCDCT is set at the H level when the VSYNC interrupt signal VSYNCINT is input during a period in which the count value CNT1<5:0> is "0" (BE1). The data INTDIV<5:0> set in the interrupt output cycle setting register 252 is loaded when the VSYNC interrupt signal VSYNCINT is input during a period in which the count value CNT1<5:0> is "0" (BE2).

The INT1 generation section INT1G receives the vertical synchronization detection signal VSYNCDCT, and generates the interrupt signal INT1 having a pulse width of two clock cycles of the system clock signal CLK (BE3). The cycle counter PCNT1 decrements the count value CNT1<5:0> each time the VSYNC interrupt signal VSYNCINT becomes active (BE4).

Figure 23:
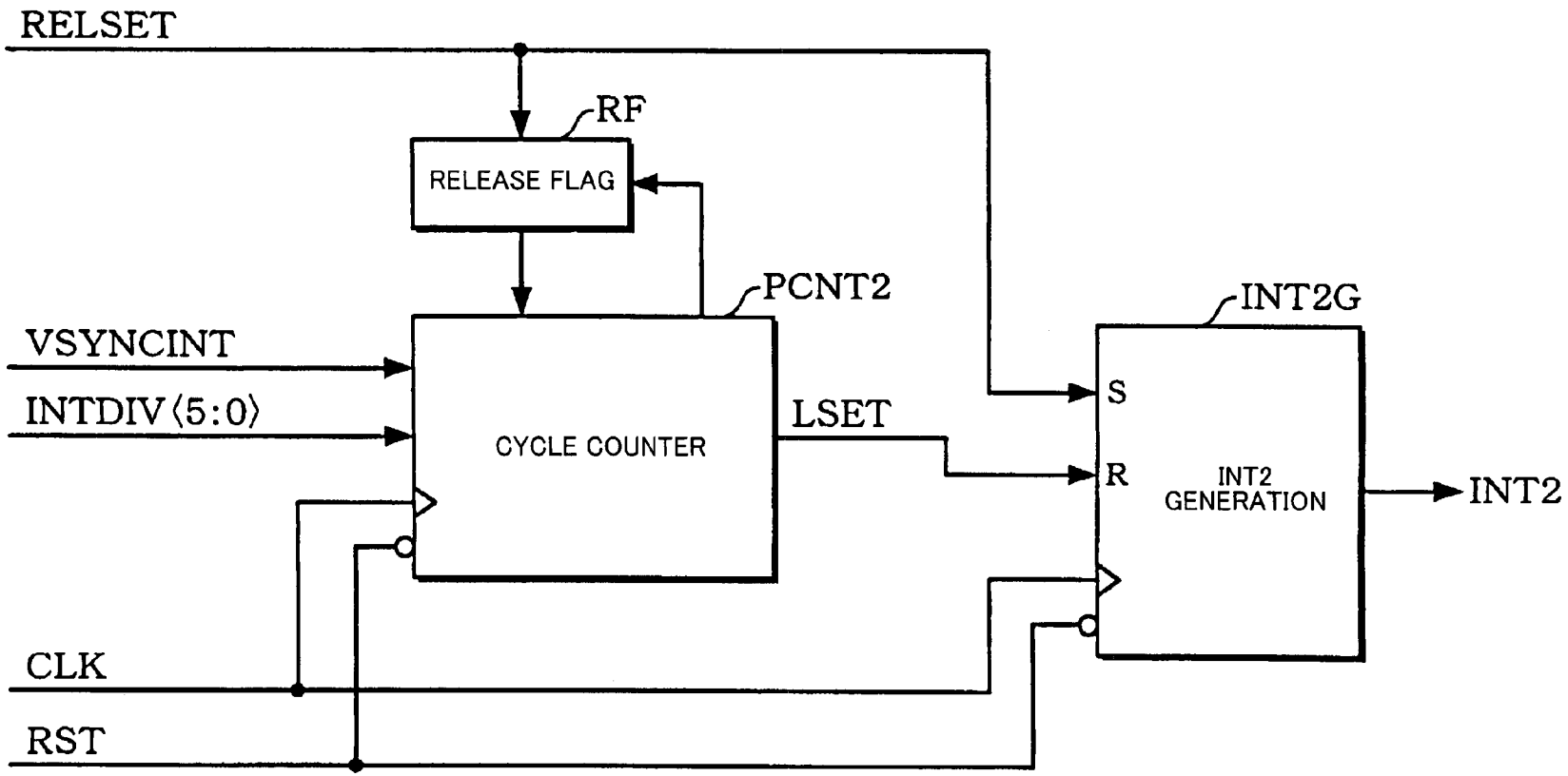
FIG. 23 shows the level interrupt signal generation section shown in FIG. 17.

FIG. 23 shows the level interrupt signal generation section 442.

Figure 24:
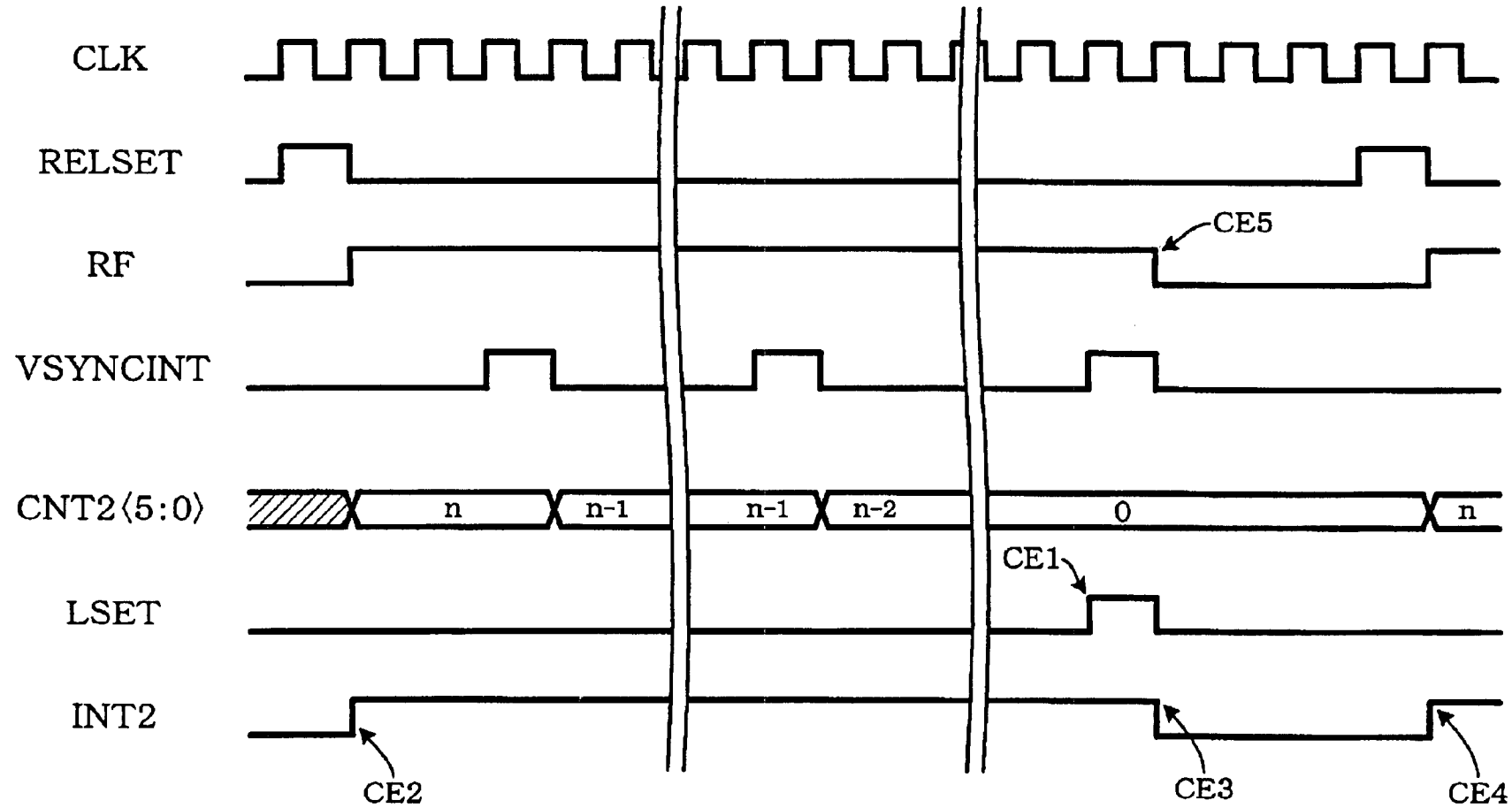
FIG. 24 is a timing chart showing an operation example of the level interrupt signal generation section shown in FIG. 23.

FIG. 24 is a timing chart showing an operation example of the level interrupt signal generation section 442 shown in FIG. 23.

A release setting signal RELSET is input to the level interrupt signal generation section 442. The release setting signal RELSET becomes active when a release command of the level-output interrupt signal is set by the host 550. The level interrupt signal generation section 442 includes a release flag RF. The release flag RF indicates whether or not the level-output interrupt signal is released by the host 550. The release flag RF is set by the release setting signal RELSET.

A cycle counter PCNT2 operates in the same manner as the cycle counter PCNT1 shown in FIG. 18. However, the cycle counter PCNT2 decrements a count value CNT2<5:0> by performing the same operation as that of the cycle counter PCNT1 when the release flag RF indicates that the level-output interrupt signal is released, differing from the cycle counter PCNT1.

In more detail, the data INTDIV<5:0> set in the interrupt output cycle setting register 252 is loaded into the cycle counter PCNT2 in synchronization with the rising edge of the release flag RF. When the release flag RF indicates that the level-output interrupt signal is released, the cycle counter PCNT2 decrements the count value CNT2<5:0> each time the VSYNC interrupt signal VSYNCINT becomes active.

When the VSYNC interrupt signal VSYNCINT is input during a period in which the release flag RF indicates that the level-output interrupt signal is released and the count value CNT2<5:0> is "0", the cycle counter PCNT2 sets a level setting signal LSET at the H level (CE1).

An INT2 generation section INT2G generates the interrupt signal INT2 which is set by the release setting signal RELSET (CE2) and is reset by the level setting signal LSET (CE3). As shown in FIG. 24, the interrupt signal INT2 reset by the level setting signal LSET is set by the next release setting signal RELSET (CE4).

The release flag RF is also reset by the level setting signal LSET (CE5).

The level interrupt signal generation section 442 is not limited to the configuration shown in FIG. 23.

Figure 25A:
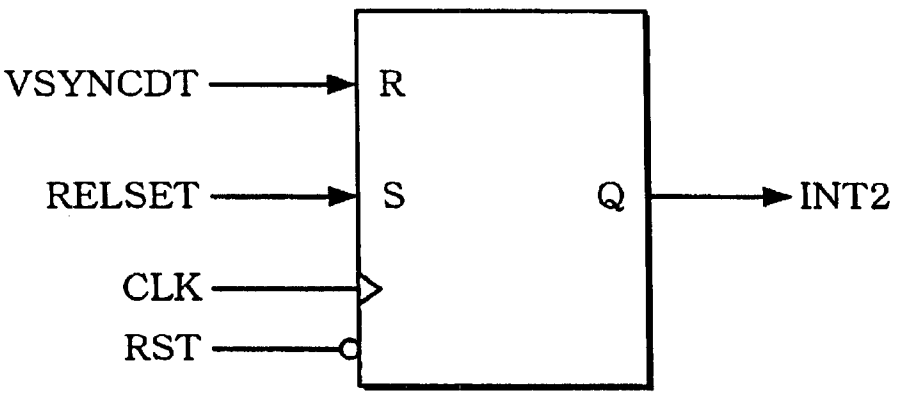
FIG. 25A shows another example of the level interrupt signal generation section shown in FIG. 17.
Figure 25B:
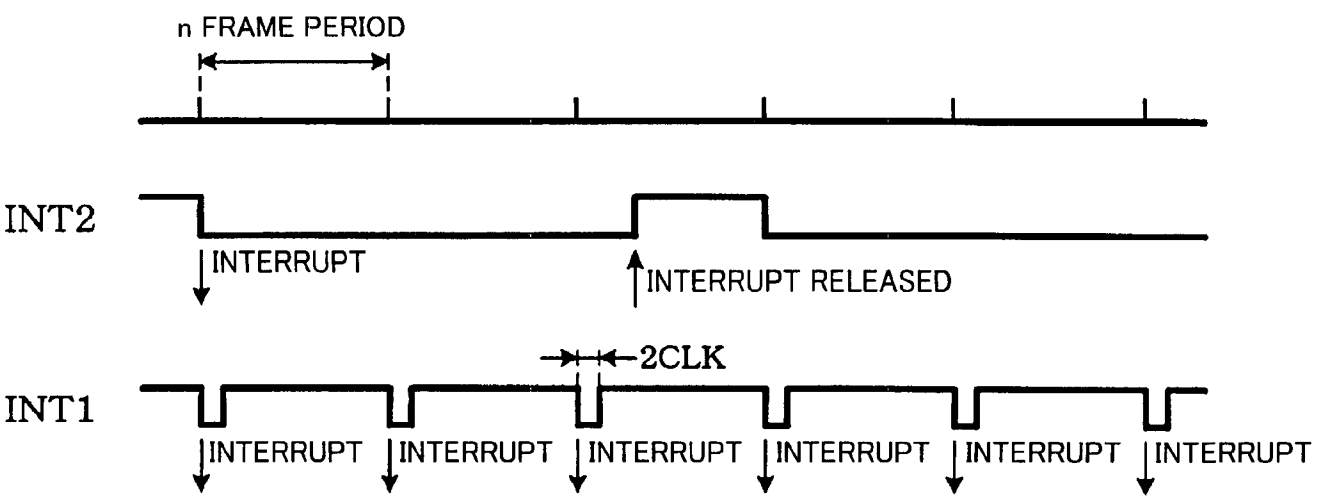
FIG. 25B shows an operation of the level interrupt signal generation section shown in FIG. 25A.

FIG. 25A shows another example of the level interrupt signal generation section 442. FIG. 25B shows an operation of the level interrupt signal generation section shown in FIG. 25A.

In FIG. 25A, the level interrupt signal generation section 442 is formed by a set-reset flip-flop. The flip-flop outputs the interrupt signal INT2 which is reset by the vertical synchronization detection signal VSYNCDCT shown in FIG. 18 and is set by the release setting signal RELSET shown in FIG. 23.

According to the configuration shown in FIG. 23, the level-output interrupt signal INT2 which becomes active when a period corresponding to the value set in the interrupt output cycle setting register 252 has elapsed after the release timing of the host 550 can be generated. According to the configuration shown in FIG. 25A, the level-output interrupt signal INT2 which is changed to active at the timing at which the pulse-output interrupt signal INT1 becomes active can be generated. The configuration can be simplified in FIG. 25A in comparison with FIG. 23.

The present invention is not limited to the above-described embodiment. Various modifications and variations are possible within the scope of the present invention. For example, the present invention may be applied not only to drive the above-described organic EL panel, but also to drive a liquid crystal display device or a plasma display device.

The pulse interrupt signal generation section 440 and the level interrupt signal generation section 442 are not limited to the configurations described with reference to FIGS. 18 to 25A and 25B. A similar interrupt signal may be generated using various configuration examples. This also falls within the scope of the present invention.

Part of requirements of any claim of the present invention could be omitted from a dependent claim which depends on that claim. Moreover, part of requirements of any independent claim of the present invention could be made to depend on any other independent claim.

Although only some embodiments of the present invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A display controller that supplies display data to a data driver driving a plurality of scan lines of a display panel based on the display data, the display controller comprising:

a frame memory that stores the display data for at least one vertical scan period, the display data being supplied from a host;

an interrupt output cycle setting register, an output cycle of an interrupt signal to be output to the host being set in units of one vertical scan period in the interrupt output cycle setting register;

an interrupt output setting register that selects whether to pulse-output or level-output the interrupt signal; and an interrupt signal generation section generating a first interrupt signal having pulses in the output cycle set in the interrupt output cycle setting register, the interrupt signal generation section generating a second interrupt signal which is set active when the output cycle set in the interrupt output cycle setting register has elapsed from a preceding active change timing and is set to inactive by the host, and the interrupt signal generation section outputting the first or second interrupt signal to the host as the interrupt signal based on a value set in the interrupt output setting register, the display controller storing the display data supplied from the host corresponding to the interrupt signal in the frame memory, the display controller reading the display data from the frame memory in a predetermined read cycle, and the display controller supplying the display data to the data driver.

2. The display controller as defined in claim 1, the interrupt signal generation section generating the second interrupt signal, the second interrupt signal being set to active when the output cycle set in the interrupt output cycle setting register has elapsed from an inactive setting timing of the host.

3. The display controller as defined in claim 1, comprising:

an interrupt output enable setting register, enable setting of output of the interrupt signal being set to the interrupt output enable setting register, the interrupt signal generation section outputting the interrupt signal to the host when the interrupt signal is enabled in the interrupt output enable setting register, and the interrupt signal generation section masking the output of the interrupt signal when the interrupt signal is disabled in the interrupt output enable setting register.

4. The display controller as defined in claim 1, the read cycle being a period longer than the one vertical scan period.

5. A display system, comprising:

a display panel that includes:

a plurality of scan lines;

a plurality of data lines; and a plurality of electroluminescent elements, each of the electroluminescent elements being specified by one of the plurality of scan lines and one of the plurality of data lines;

a scan driver that scans the plurality of scan lines;

a data driver that drives the plurality of data lines; and the display controller as defined in claim 1, the display controller outputting the interrupt signal to the host, the display controller storing the display data supplied from the host corresponding to the interrupt signal in the frame memory, the display controller reading the display data from the frame memory in a predetermined read cycle, and the display controller outputting the display data to the data driver.

6. A display system, comprising:

a display panel that includes:

a plurality of scan lines;

a plurality of data lines; and a plurality of electroluminescent elements, each of the electroluminescent elements being specified by one of the plurality of scan lines and one of the plurality of data lines;

a scan driver that scans the plurality of scan lines;

a data driver that drives the plurality of data lines; and the display controller as defined in claim 2, the display controller outputting the interrupt signal to the host, the display controller storing the display data supplied from the host corresponding to the interrupt signal in the frame memory, the display controller reading the display data from the frame memory in a predetermined read cycle, and the display controller outputting the display data to the data driver.

7. A display system, comprising:

a display panel that includes:

a plurality of scan lines;

a plurality of data lines; and a plurality of electroluminescent elements, each of the electroluminescent elements being specified by one of the plurality of scan lines and one of the plurality of data lines;

a scan driver that scans the plurality of scan lines;

a data driver that drives the plurality of data lines; and the display controller as defined in claim 3, the display controller outputting the interrupt signal to the host, the display controller storing the display data supplied from the host corresponding to the interrupt signal in the frame memory, the display controller reading the display data from the frame memory in a predetermined read cycle, and the display controller outputting the display data to the data driver.

8. A display system, comprising:

a display panel that includes:

a plurality of scan lines;

a plurality of data lines; and a plurality of electroluminescent elements, each of the electroluminescent elements being specified by one of the plurality of scan lines and one of the plurality of data lines;

a scan driver that scans the plurality of scan lines;

a data driver that drives the plurality of data lines; and the display controller as defined in claim 4, the display controller outputting the interrupt signal to the host, the display controller storing the display data supplied from the host corresponding to the interrupt signal in the frame memory, the display controller reading the display data from the frame memory in a predetermined read cycle, and the display controller outputting the display data to the data driver.

9. A display control method that supplies display data to a data driver driving a display panel including a plurality of scan lines and a plurality of data lines based on the display data, the display control method comprising:

generating a first interrupt signal having pulses in an output cycle set in an interrupt output cycle setting register, generating a second interrupt signal which is set to active when the output cycle set in the interrupt output cycle setting register has elapsed from a preceding active change timing and is set to inactive by a host, outputting either the first interrupt signal or the second interrupt signal as an interrupt signal to the host in the output cycle in units of one vertical scan period;

receiving the display data supplied from the host corresponding to the interrupt signal, and storing the display data for at least one vertical scan period in a frame memory; and reading the display data from the frame memory in a predetermined read cycle, and supplying the display data to the data driver.

10. The display control method as defined in claim 9, the read cycle being a period longer than the one vertical scan period.

* * * * *